US007367203B2

(12) United States Patent
Katoh et al.

(10) Patent No.: US 7,367,203 B2
(45) Date of Patent: May 6, 2008

(54) REFRIGERANT EVAPORATOR

(75) Inventors: Yoshiki Katoh, Chita-gun (JP); Etsuo Hasegawa, Nagoya (JP); Masaaki Kawakubo, Obu (JP)

(73) Assignee: Denso Corporation, Kariya (JP)

( * ) Notice: Subject to any disclaimer, the term of this patent is extended or adjusted under 35 U.S.C. 154(b) by 333 days.

(21) Appl. No.: 11/100,155

(22) Filed: Apr. 6, 2005

(65) Prior Publication Data

US 2005/0235691 A1 Oct. 27, 2005

(30) Foreign Application Priority Data

Apr. 8, 2004 (JP) ..... 2004-114569

(51) Int. Cl.
*F25B 39/02* (2006.01)
*F25B 23/00* (2006.01)

(52) U.S. Cl. ..... 62/515

(58) Field of Classification Search ..... 62/239, 62/430, 503, 504, 509, 515, 526; 165/132, 165/139, 153, 165, 166, 168, 173, 174, 176, 165/178; 220/4.12; 29/890.07; 159/28.6
See application file for complete search history.

(56) References Cited

U.S. PATENT DOCUMENTS 5,241,839 A * 9/1993 Hughes ..... 62/515
5,448,899 A * 9/1995 Ohara et al. ..... 62/525
5,562,157 A * 10/1996 Hasegawa et al. ..... 165/144
5,934,367 A * 8/1999 Shimmura et al. ..... 165/174
6,516,486 B1 * 2/2003 Mehendale et al. ..... 62/503
6,827,139 B2 * 12/2004 Kawakubo et al. ..... 165/173
2003/0188857 A1 * 10/2003 Kawakubo et al. ..... 165/174
2004/0159121 A1 * 8/2004 Horiuchi et al. ..... 62/526
2004/0206490 A1 * 10/2004 Katoh et al. ..... 165/176
2006/0288733 A1 * 12/2006 Shinmura et al. ..... 62/515

FOREIGN PATENT DOCUMENTS

JP 2004-044851 A 2/2004

* cited by examiner

*Primary Examiner*—Frantz Jules
*Assistant Examiner*—Joseph Corrigan
(74) *Attorney, Agent, or Firm*—Harness, Dickey & Pierce, PLC

(57) ABSTRACT

A refrigerant evaporator includes a tank constituted by a tank portion and a header plate. The tank portion includes refrigerant collecting portions for guiding the refrigerant passed through a first path to the ends of the tank in the right-and-left direction and refrigerant distributing portions for guiding the refrigerant to the tubes forming a second pass. The header plate has refrigerant collecting/distributing space for the tubes. Side tanks are arranged to cover open portions at the ends of the tank in the right-and-left direction, and to spatially connect the flow passages. Separators are provided at portions where the flow passages are to be spatially blocked to constitute a front-and-rear right-and-left cross path. An increased sectional area of flow passages is obtained at the refrigerant flow corner portions relying upon a simple constitution, to decrease the pressure loss on the refrigerant side in the tank and to enhance performance.

21 Claims, 22 Drawing Sheets

REFRIGERANT EVAPORATOR

CROSS REFERENCE TO RELATED APPLICATION

This application is based on Japanese Patent Application No. 2004-114569 filed on Apr. 8, 2004, the disclosure of which is incorporated herein by reference.

FIELD OF THE INVENTION

This invention relates to a refrigerant evaporator for evaporating the refrigerant in a refrigerating cycle, which can be favorably used, for example, for an air conditioning system for vehicles. The refrigerant evaporator can be further used as an outdoor heat exchanger in a heat pump cycle.

BACKGROUND OF THE INVENTION

In recent years, study has been forwarded to control the airflow rates independently for the driver's seat and the assistant's seat to meet the requirements of the users of the vehicles. The above requirements have been heretofore been satisfied by controlling the airflow rate through the refrigerant evaporator independently on the right side and on the left side in the direction of core width. When the airflow rate is to be independently controlled on the right side and on the left side of the refrigerant evaporator in which the heat-exchanging tubes are longitudinally arranged, it has been necessary for the refrigerant evaporator to have a structure in which a separator is inserted in a tank to separate the flow of refrigerant in the direction of core width, so that the refrigerant flows through passages that are different depending on the right side and the left side.

This, however, results in an increase in the distance of the refrigerant flow passages and, hence, in an increase in the pressure loss making it difficult to improve performance of the refrigerant evaporator. To cope with this, therefore, the present inventors have proposed a refrigerant evaporator as disclosed in Japanese Patent Application No. 2003-434216 (U.S. patent application Ser. No. 10/827,559). According to this refrigerant evaporator, the refrigerant flowing through a first path on the front surface is folded to a second path on the back surface and, at this moment, the flow is changed over right side left to decrease the pressure loss on the refrigerant side, to improve the temperature distribution and to independently control the airflow rate on the right side and on the left side (hereinafter, this new refrigerant path system is referred to as front-and-rear right-and-left cross path).

The problem, however, has been how to realize the heat exchanger having the front-and-rear right-and-left cross path in a simple constitution that facilitates the mass production.

SUMMARY OF THE INVENTION

The present invention was accomplished in view of the problems inherent in the above prior art and its object is to provide a refrigerant evaporator having a simplified tank structure yet constituting the front-and-rear right-and-left cross path and producing less pressure loss on the refrigerant side.

In the refrigerant evaporator of the invention, the flow of the refrigerant constitutes at least a first path portion and a second path portion between a refrigerant inlet portion and a refrigerant outlet portion. The refrigerant evaporator includes a core portion formed by rows of tubes arranged in parallel, refrigerant collecting portions where the refrigerant is collected flowing through the first path portion, and refrigerant distributing portions for distributing the refrigerant to the second path portion. The core portion has a first row of tubes and a second row of tubes on the front and rear sides, respectively, to form the first path portion and the second path portion on the nearly right and left whole regions. The refrigerant collecting portions have a structure for collecting the refrigerant of the first path portion in a manner of being divided to the right and the left, the refrigerant distributing portions are formed by a pair of tank portions disposed front and rear, and has a structure in which the second path portion is formed in a region different from the first path portion in terms of the right-and-left direction, the refrigerant collecting portions and the refrigerant distributing portions being connected together through a pair of communication members.

Namely, the tank portion of the refrigerant evaporator is of a form in which the refrigerant passed through the first path portion on the downstream side in the direction of air flow is introduced into the second path portion on the upstream side in the direction of air flow being switched over right side left of the core portion, the tank portion being constituted by the tank portions having the refrigerant collecting portions which are flow passages having a function for guiding the refrigerant flew through the first path portion to the ends of the tank in the right-and-left direction and the refrigerant distributing portions which are flow passages for guiding the refrigerant to a group of tubes forming the second path portion, and by a header plate having a refrigerant collecting space for the tubes, and wherein the side tanks (communication members) are provided to envelop the open portions at the ends of the tank portion in the right-and-left direction and to spatially connect the above flow passages, and separators (flow-preventing weirs) are provided at portions for accomplishing the spatial blocking thereby to constitute the front-and-rear right-and-left cross path.

According to the present invention, increased sectional areas of the flow passages are obtained at the ends of the tank portion in the right-and-left direction (refrigerant flow corner portions) by simple means making it possible to decrease the pressure loss on the refrigerant side in the tank and to improve performance.

The invention is further concerned with a refrigerant evaporator for exchanging the heat between a fluid to be cooled flowing through the outer portion and a refrigerant flowing through the inner portion, wherein the flow of the refrigerant has at least a first path portion and a second path portion between a refrigerant inlet portion and a refrigerant outlet portion, and a core portion formed by rows of tubes arranged in parallel, refrigerant collecting portions where the refrigerant is collected flowing through the first path portion, refrigerant distributing portions for distributing the refrigerant to the second path portion, and a pair of tank portions for communicating the refrigerant collecting portions with the refrigerant distributing portions, wherein the core portion has a first row of tubes and a second row of tubes to form the first path portion and the second path portion on nearly the right and left whole regions; the refrigerant collecting portions and the refrigerant distributing portions are divided to the right and left, respectively; and the pair of tank portions communicate the refrigerant collecting portions with the refrigerant distributing portions of separate regions in the right-and-left direction, respectively.

The tank portions for changing over the flow of the refrigerant constitutes the front-and-rear right-and-left cross path by laminating a header plate and a tank header plate which form the tank portions as two flow passages in a vertical direction at right angles with the direction of the air flow or with the direction in which the tubes are arranged in parallel, a space-forming plate forming a refrigerant collecting/distributing space for the tubes, and a distributing plate having a separator function for guiding the refrigerant from the space-forming plate to two flow passages ahead and another separator function for separating the two flow passages.

According to the present invention, further, the flow of the refrigerant has decreased corner portions and a short flow passage in the tanks, making it possible to decrease the pressure loss on the refrigerant side in the tanks and to improve performance.

DETAILED DESCRIPTION OF EMBODIMENT

First Embodiment

Figure 1A:
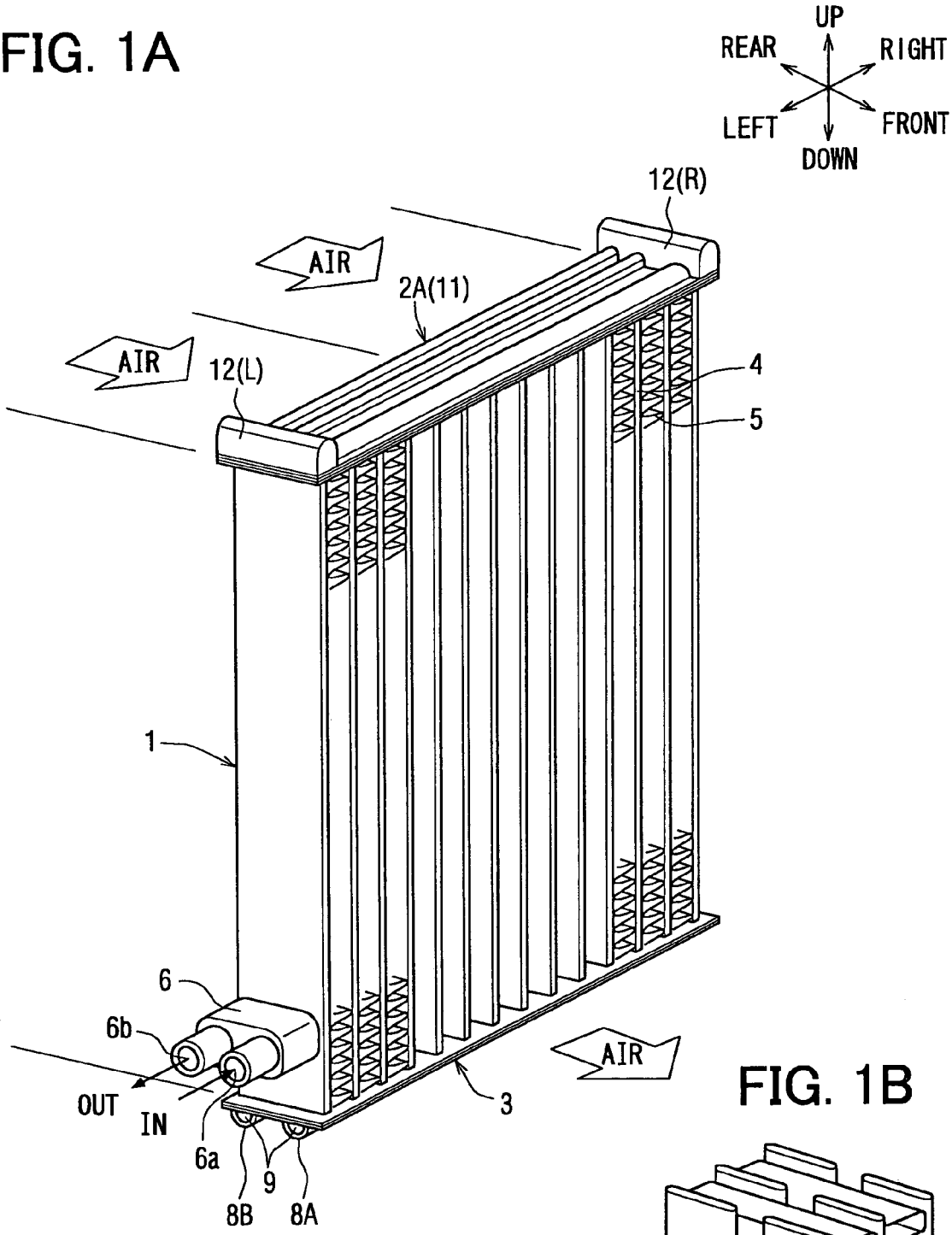
FIGS. 1A and 1B are perspective views of a refrigerant evaporator according to a first embodiment of the present invention.
Figure 1B:
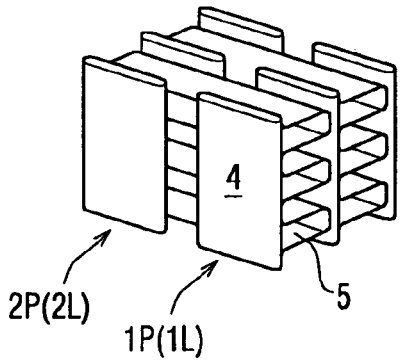
Figure 2:
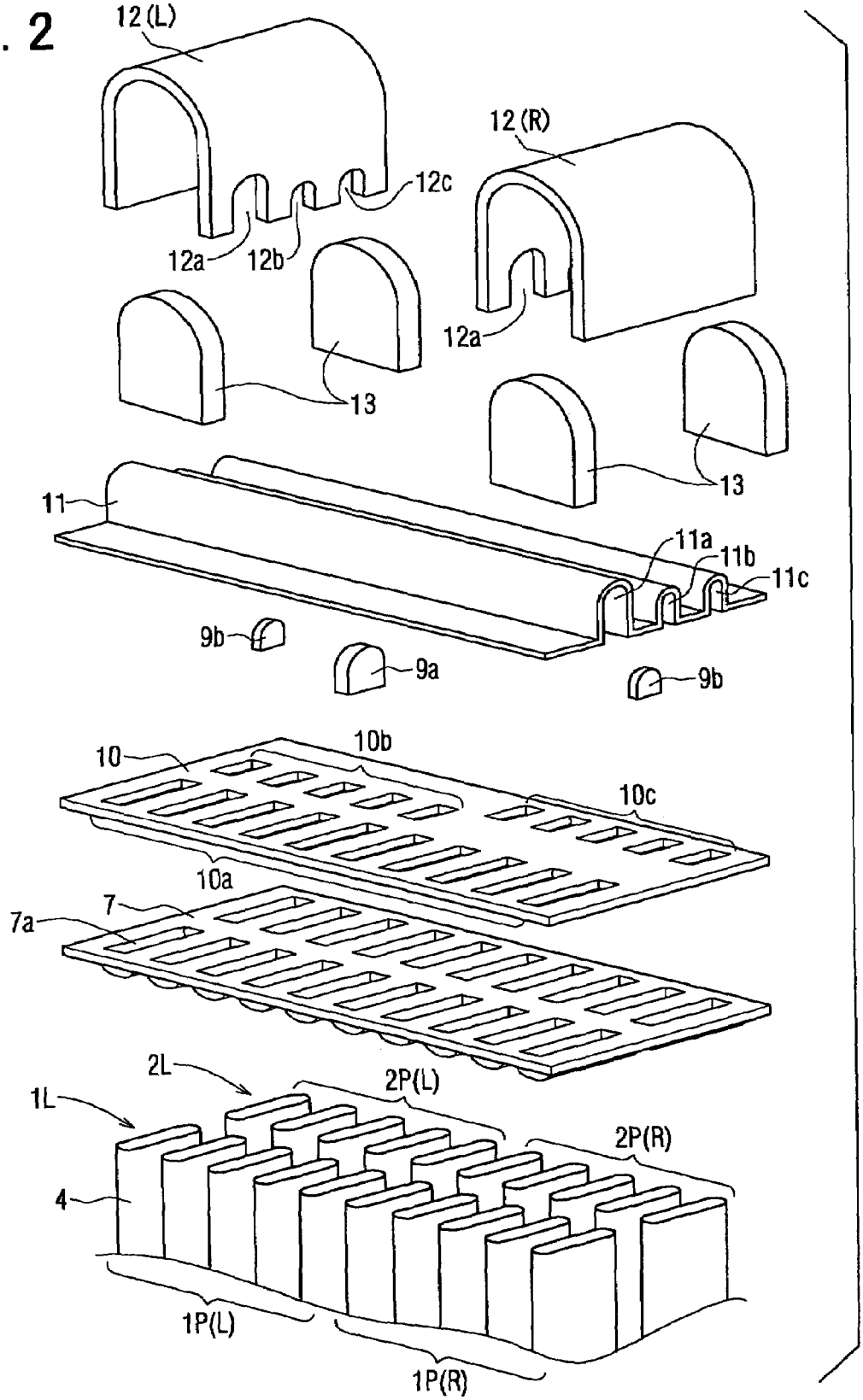
FIG. 2 is a perspective view illustrating, in a disassembled manner, the constitution of an upper tank portion in the refrigerant evaporator of FIG. 1A.

An embodiment of the invention will now be described in detail with reference to the drawings. FIG. 1 is a perspective view of a refrigerant evaporator 1 according to a first embodiment of the invention, and FIG. 2 is a perspective view illustrating, in a disassembled manner, the constitution of an upper tank portion in the refrigerant evaporator of FIG. 1A. In this specification, the front-and-rear direction is such that the leeward side is the front and the windward side is the rear, and the right-and-left direction stands for the direction of the width of the core in which the tubes (flat tubes) 4 are arranged on an orthogonal plane facing the direction of the airflow.

This embodiment is applied to the front-and-rear U-turn evaporator of the constitution in which the path stretches in the direction of whole width, and the description deals with a case where the refrigerant evaporator 1 of the invention is applied to the supercritical refrigerating cycle that operates when the refrigerant pressure of the high-pressure side becomes greater than a critical pressure by using a carbon dioxide refrigerant (hereinafter, $CO_2$ refrigerant). The $CO_2$ refrigerant of which the pressure is decreased by an expansion valve (not shown) on the upstream side of the refrigerant, flows in to exchange the heat with the air through the evaporator 1, and the vaporized refrigerant flows out to the downstream side.

The evaporator is of the multi-flow (MF) type in which a front row of tubes (first row of tubes) 1L that serves as a front core portion (first path portion) 1P and a rear row of tubes (second row of tubes) 2L that serves as a rear core portion (second path portion) 2P are arranged between the upper tank portion (refrigerant collecting/distributing portion) 2A and the lower tank portion (refrigerant inlet/outlet portion) 3. The refrigerant introduced through the refrigerant inlet portion 6*a* of the connector 6 flows (guided) into the core portion from the side of the front lower tank portion 8A, flows out (guided) from the lower tank portion 8B, and is drained from the refrigerant outlet portion 6*b* of the connector 6. Both ends of the front and rear lower tank portions 8A and 8B are sealed with caps 9.

The core portions 1P and 2P are such that heat-absorbing fins (corrugated fins) 5 are arranged as shown in the drawings among the gaps formed by the tubes 4, front row of the tubes 1L and rear row of the tubes 2L. FIG. 1(*b*) illustrates in detail the positional relationship between the tubes 4 and the corrugated fins 5. In the illustrated embodiment, the first path is realized by the front core portion (front row of the tubes) 1P creating an ascending stream. Like in the prior art, an orthogonal counter-flow is created offering advantages in performance and in temperature. A favorable distribution for the tubes 4 is obtained and the temperature distribution can be uniformed when the refrigerant is introduced from the lower side with the first path portion 1P on the front side.

The connector 6 may be arranged on the upper side so that the first path 1P creates the descending stream. Further, the first path 1P may be realized by the rear core portion (second row of the tubes) 2P. In the front-and-rear U-turn evaporator, the refrigerant that has flown through a path is changed over in the direction of width of the core. The following description deals with a case where the tubes 4 are all changed over in the direction of width of the core. The invention, however, exhibits its effect even when the tubes are partly changed over.

The tank portion 2A of this embodiment is formed by stacking a header plate 7, a distribution plate 10, a tank header plate 11 and side tanks (communication members) 12 roughly on the core portion. The tank header plate 11 is obtained by press-forming a plate member so as to form three tank portions 11*a* to 11*c* (one wide tank and two narrow tanks) in the front-and-rear direction. The tank portion 11*a* works as a refrigerant collecting portion, and the tank portions 11*b* and 11*c* work as refrigerant distributing portions.

The distributing plate 10 is obtained by perforating in a plate, by press work, a group of communication holes 10*a* over the full length of the refrigerant collecting portion corresponding to the tank portion 11*a* on the front side, a group of communication holes 10*b* in the refrigerant distributing portion corresponding to the tank portion 11*b* on the left half portion on the rear side and a group of communication holes 10*c* in the refrigerant distributing portion corresponding to the tank portion 11*c* on the right half portion on the rear side. The group of communication holes 10*a* of the front side is corresponded to the upper open ends of the tubes 4 of the front core portion (front row of the tubes) 1P, the group of communication holes 10*b* of the rear side is corresponded to the upper open ends of the tubes 4 of the left half 2P(L) of the rear core portion (rear row of the tubes) 2P, and the group of communication holes 10*c* of the rear side are corresponded to the upper open ends of the tubes 4 of the right half 2P(R) of the rear core portion (rear row of the tubes) 2P.

The header plate 7 is for connecting the tubes 4 and is obtained by forming in a plate, by presswork, tubular holes (not shown) corresponding to the tubes 4 and refrigerant collecting spatial portions 7*a*. The side tanks 12 which are major portions of the invention are for spatially connecting the flow passages formed by the tank portions 11*a* to 11*c* enveloping the open end portions of the tank portions 11*a* to 11*c* in the right-and-left direction. The side tanks 12 are obtained by pressing a plate member forming openings 12*a* to 12*c* so as to be corresponded to the tank portions 11*a* to 11*c*.

Side caps 13 which are the sealing members are arranged at both ends of the side tank 12 in the axial direction. Further, separators 9*a* are arranged in the tank portion 11*a* to divide the flow passage into the right and the left, and separators (flow-preventing weirs) 9*b* are arranged at places where the flow passages are shut off between the tank portions 11*b*, 11*c* and the side tanks 12. The separators 9 may not be to completely block the flow of the refrigerant. These parts are all made of aluminum, and are stacked and are joined integrally together by brazing.

Figure 3:
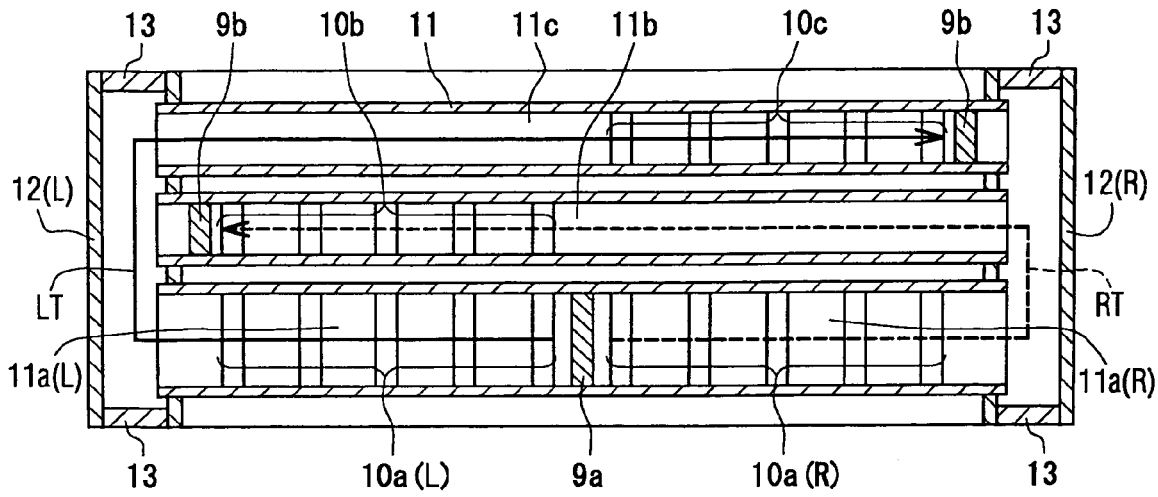
FIG. 3 is a sectional plan view horizontally cutting the upper tank portion of the refrigerant evaporator of FIG. 1A.

Next, described below is the flow of the refrigerant in the refrigerant evaporator 1 of the above structure. FIG. 3 is a sectional plan view horizontally cutting the upper tank portion 2A of the above structure, and FIG. 4 is a view schematically illustrating the flow of the refrigerant. In this embodiment, the flow of the refrigerant is changed over in the direction of width of the core in a manner as described below. The refrigerant is collected in the right tank portion 11*a*(R) from the right row of the tubes in the front core portion 1P which is the first path 1P(R) flowing through the group of communication holes 10*a*(R), flows into the tank portion 11*b* through the right side tank 12(R), flows into the left row of the tubes in the rear core portion 2P through the group of communication holes 10*b* of the left side, and is shifted to the second path 2P(L) of the left side (see a thick dotted line RT).

In the tank header plate 11 shown in FIG. 2, there are formed grooves with their both ends opened as tank portions 11*a*, 1*b* and 1*c*. The separators 9*a* and 9*b* are provided as sectionalizing means for specifying the ends of the tanks in the longitudinal direction. The sectionalizing means constitutes separator means for dividing the interior of the tank into a plurality of sections or constitutes closing means for closing the ends of the tanks. The sectionalizing means can be integrally formed in the tank header plate 11. For example, the sectionalizing wall surfaces can be formed by crushing the intermediate portions or the end portions of the tank portions 11*a*, 11*b* and 11*c* that are formed in a protruding manner as shown in FIG. 2. Or, a groove with a terminated end may be formed in the tank header plate 11 in a protruding manner. For example, the tank portions 11*a*, 11*b* and 11*c* may be so formed as to come in contact with the distributing plate 10 at any one or all positions of the separators 9*a*, 9*b*.

Figure 4A:
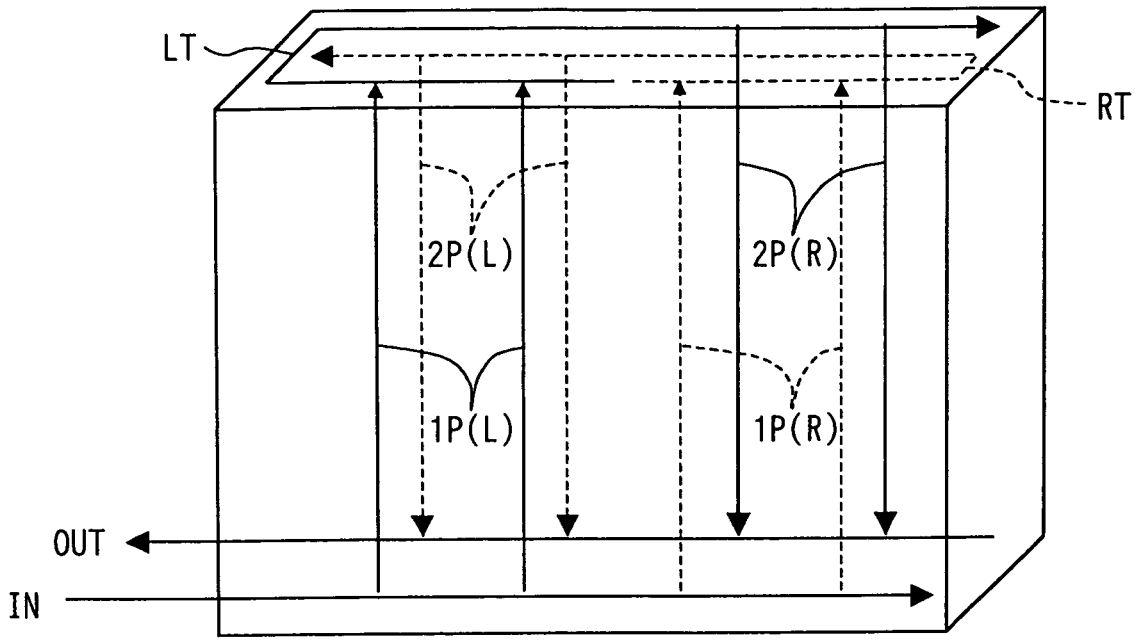
FIGS. 4A and 4B are views schematically illustrating the flow of the refrigerant in the refrigerant evaporator of FIG. 1.
Figure 4B:
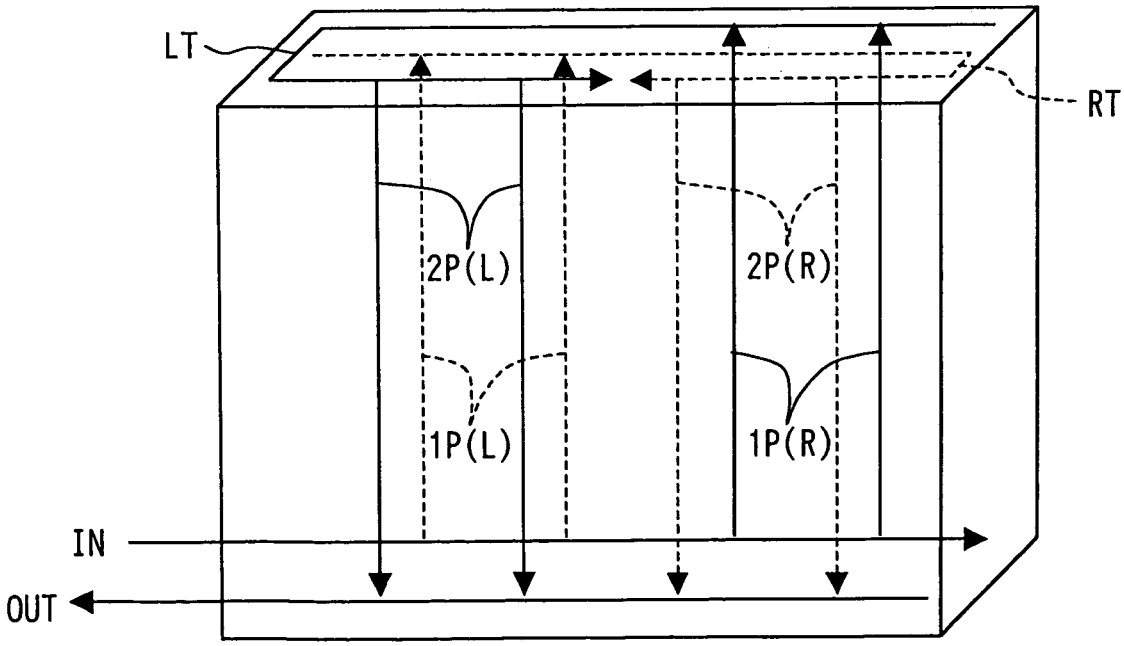

On the other hand, the refrigerant collected in the tank portion 11*a*(L) from the left row of the tubes of the front core portion 1P which is the left first path 1P(L) through the group of communication holes 10*a*(L), flows into the tank portion 11*c* through the left side tank 12(L), flows into the right row of the tubes of the rear core portion 2P through the group of communication holes 10*c* of the right side and is changed over to the right second path 2P(R) (see a thick solid line LT). FIG. 4B is the one in which the flow-in/flow-out directions of the refrigerant are changed over relative to FIG. 4A, illustrates the same constitution of flow passages irrespective of from which direction the refrigerant is flown, and is not described here in detail.

Next, described below are the feature and the effect of the embodiment. First, the refrigerant evaporator exchanges the heat between the air flowing through the outer portion and the refrigerant flowing through the inner portion. The flow of the refrigerant has at least the first path portion 1P and the second path portion 2P between the refrigerant inlet portion 6*a* and the refrigerant outlet portion 6*b*. The refrigerant evaporator includes a core portion formed by a row of the tubes 4 arranged in parallel, refrigerant collecting portions 10*a*, 11*a* where the refrigerant is collected flowing through the first path portion 1P, and refrigerant distributing portions 10*b*, 10*c*, 11*b*, 11*c* for distributing the refrigerant to the second path portion 2R The core portion has a first row 1L of the tubes and a second row 2L of the tubes on the front and rear sides, respectively, to form the first path portion 1P and the second path portion 2P on the right and left whole regions. The refrigerant collecting portions 10*a*, 11*a* have a structure for collecting the refrigerant of the first path portion 1P in a manner of being divided to the right and the left. The refrigerant distributing portions 10*b*, 10*c*, 11*b*, 11*c* are formed by a pair of tank portions 11*b*, 11*c* disposed front and rear, and has a structure for distribution in which the second path portion 2P is formed in a separate region from the first path portion 1P in terms of the right-and-left direction. The refrigerant collecting portions 10*a*, 11*a* and the refrigerant distributing portions 10*b*, 10*c*, 11*b*, 11*c* are connected together through the pair of side tanks 12.

Namely, the tank portion 2A of the refrigerant evaporator (heat exchanger) is of a form in which the refrigerant passed through the first path portion 1P on the downstream side in the direction of air flow is introduced into the second path portion 2P on the upstream side in the direction of air flow being switched over right side left of the core portion, the tank portion 2A being constituted by the tank portions having the refrigerant collecting portions 10*a*, 11*a* which are flow passages having a function for guiding the refrigerant flew through the first path portion 1P to the ends of the tank in the right-and-left direction and the refrigerant distributing portions 10*b*, 10*c*, 11*b*, 11*c* which are flow passages for guiding the refrigerant to a group of tubes 4 forming the second path portion 2P, and by a header plate 7 having a refrigerant collecting space for the tubes 4, and wherein the side tanks 12 are provided to envelop the open portions at the ends of the tank portion in the right-and-left direction and to spatially connect the above flow passages, and separators 9 are provided at portions for accomplishing the spatial interruption thereby to constitute the front-and-rear right-and-left cross path.

According to the above constitution, an increased sectional area of the flow passage is obtained at the ends of the tank portion in the right-and-left direction (refrigerant flow corner portions) by simple means making it possible to decrease the pressure loss on the refrigerant side in the tank and to improve performance. Further, the refrigerant collecting portions 10*a*, 11*a* and the refrigerant distributing portions 10*b*, 10*c*, 11*b*, 11*c* are formed by laminating a header plate 7 for connecting the tubes 4, a tank header plate 11 forming the tank portions 11*a* to 11*c* integrally together, and a distributing plate 10 arranged therebetween and having communication holes 10*a* to 10*c* for communicating the tubes 4 with the tank portions 11*a* to 11*c*.

In the drawings illustrating the embodiment, the tank portion 11*a* is drawn in a large size and the tank portions 11*b*, 11*c* are drawn in a small size. However, they may have an equal size and no limitation is imposed on the size of the flow passages. If the tank portions 11*a* to 11*c* are uniformly arranged, the side tank 12 can be used for either the right side or the left side, and there is no difference in the size of the separators 9.

Another Embodiment 1

Figure 5A:
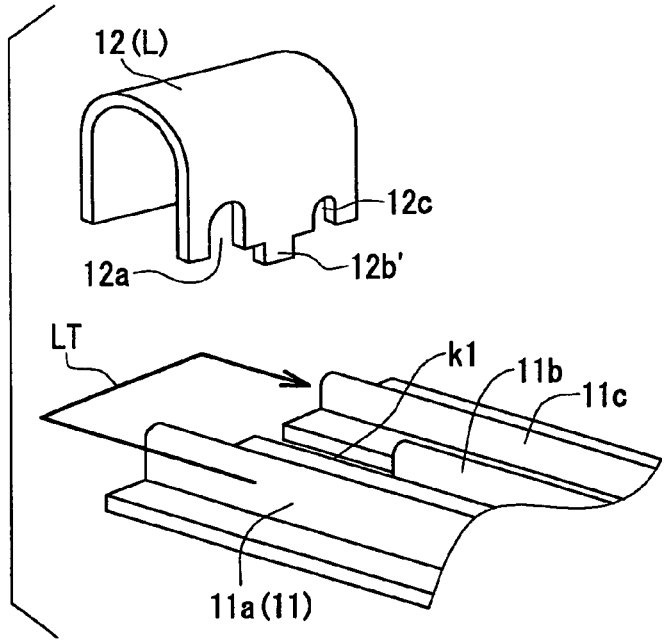
FIG. 5A is a partial perspective view illustrating another embodiment 1 of the refrigerant evaporator of FIG. 1.
Figure 5B:
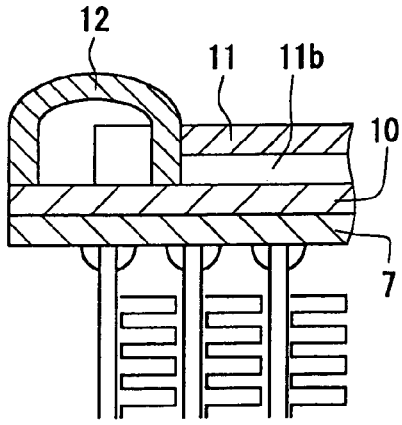
FIG. 5B is a partial sectional view vertically cut at the center thereof in FIG. 5A.

FIG. 5A is a partial perspective view illustrating another embodiment 1 of the refrigerant evaporator 1 of FIG. 1, and FIG. 5B is a partial sectional view of the tank portion 11*b* vertically cut at the center thereof in FIG. 5A. The communication is blocked by using the side surface portion of the side tank 12 at a portion where the tank portions 11*b*, 11*c* are not to be communicated with the interior of the side tank 12. More concretely, FIG. 5A illustrates a portion where the tank portion 11*a* is communicated with the tank portion 11*c* through the side tank 12 at the left end of the upper tank 2A and is not communicated with the tank portion 11*b*.

For this purpose, a cut-away portion k1 is formed in the tank portion 11*b* at an end in the longitudinal direction, and the side tank 12 is not provided with an opening 12*b* but has a shape 12*b*' corresponding to the cut-away portion k1. The outer side surface of the side tank 12 is brought into contact with the end that is cut away in the longitudinal direction to block the communication. This makes it possible to omit the separators 9*b* which are the constituent parts and, hence, to suppress the cost. Further, the cut-away portion k can be used for positioning the side tank 12 in the direction of width of the core portion.

Another Embodiment 2

Figure 6A:
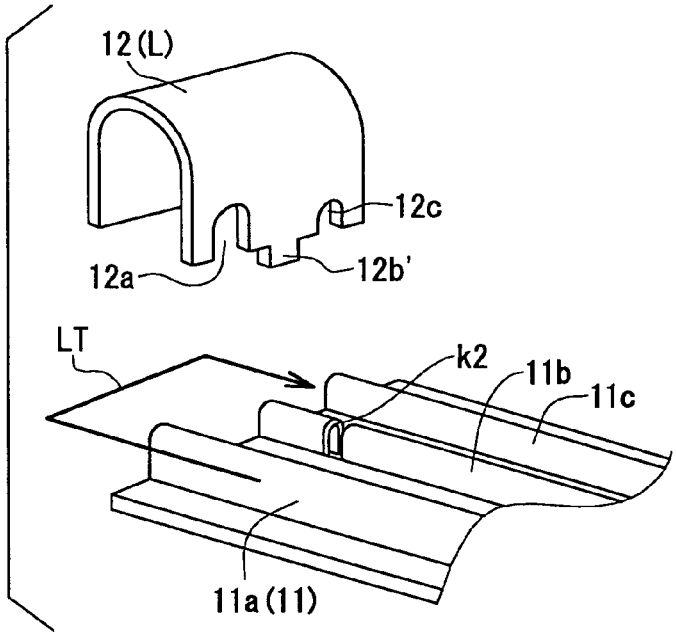
FIG. 6A is a partial perspective view illustrating another embodiment 2 of the refrigerant evaporator of FIG. 1.
Figure 6B:
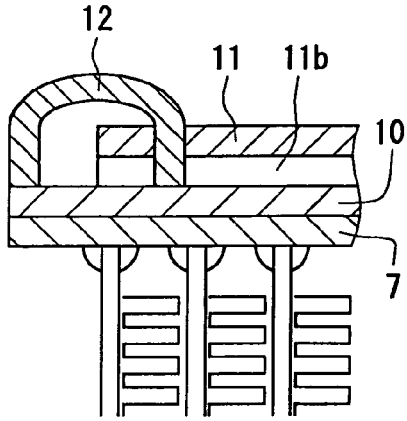
FIG. 6B is a partial sectional view vertically cut at the center thereof in FIG. 6A.

FIG. 6A is a partial perspective view illustrating another embodiment 2 of the refrigerant evaporator 1 of FIG. 1, and FIG. 6B is a partial sectional view of the tank portion 11*b* vertically cut at the center thereof in FIG. 6A. A cut portion k2 is formed instead of the cut-away portion k1 at the same portion as that of the above embodiment 1, and one side surface of the side tank 12 is inserted in the cut portion k2 to block the communication. This also makes it possible to omit the separators 9*b* which are the constituent parts and, hence, to suppress the cost. Further, the cut portion k2 works to more reliably position the side tank 12 in the direction of width of the core portion.

Another Embodiment 3

Figure 7A:
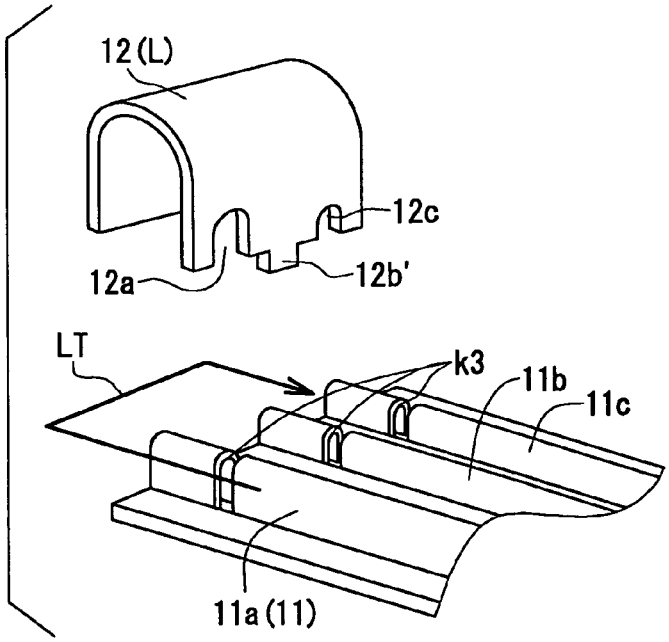
FIG. 7A is a partial perspective view illustrating another embodiment 3 of the refrigerant evaporator of FIG. 1.
Figure 7B:
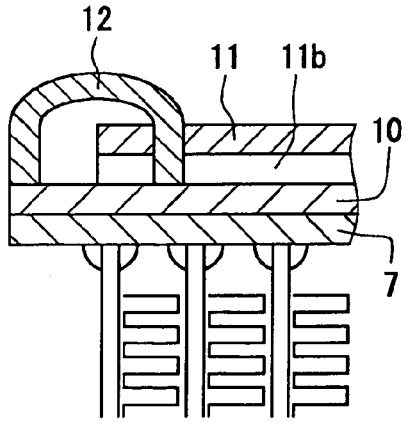
FIG. 7B is a partial sectional view vertically cut at the center thereof in FIG. 7A.

FIG. 7A is a partial perspective view illustrating another embodiment 3 of the refrigerant evaporator 1 of FIG. 1, and FIG. 7B is a partial sectional view of the tank portion 11*b* vertically cut at the center thereof in FIG. 7A. Cut portions k3 are formed over the tank portions 11*a* to 11*c* instead of the cut portion k2 at the same portion as that of the above embodiment 2. One side surface of the side tank 12 is inserted in the cut portions k3, and openings 12*a* and 12*c* are formed in the side surface of the side tank 12 at positions corresponding to the tank portions 11*a*, 11*c* communicated with the interior of the side tank 12. The portion which is not to be communicated is formed in a shape 12*b*' to block the communication.

This also makes it possible to omit the separators 9*b* which are the constituent parts and, hence, to suppress the cost. Further, the cut portions k3 work to more reliably position the side tank 12 in the direction of width of the core portion, and can be machined more easily than the cut-away portion k1 of the embodiment 1.

Another Embodiment 4

Figure 8A:
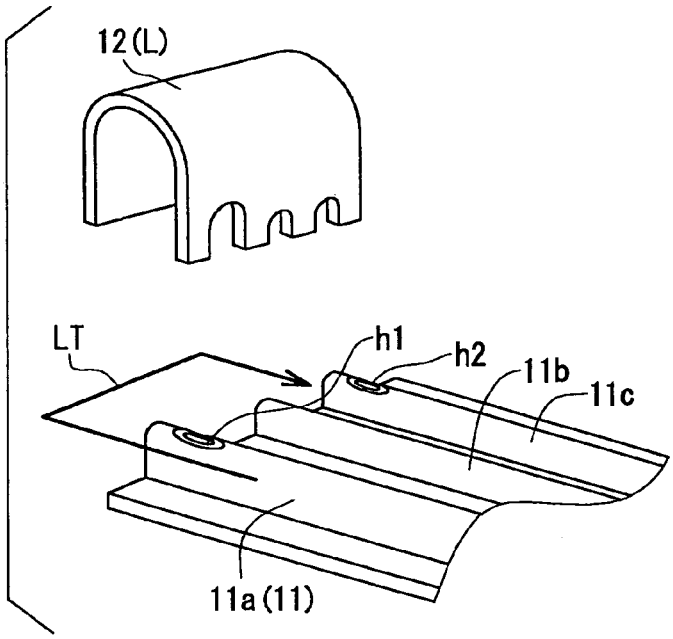
FIG. 8A is a partial perspective view illustrating another embodiment 4 of the refrigerant evaporator of FIG. 1, and FIGS. 8B, 8C and 8D are partial sectional view vertically cut in FIG. 8A.
Figure 8B:
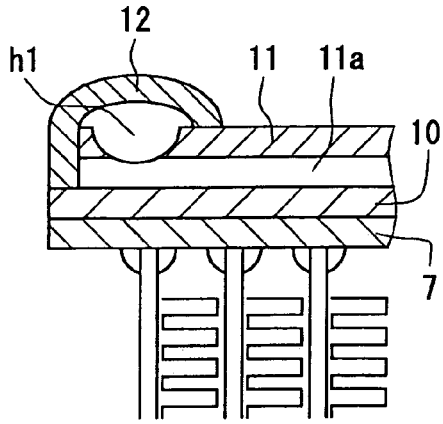
Figure 8C:
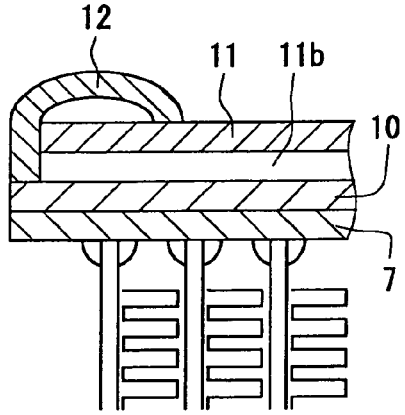
Figure 8D:
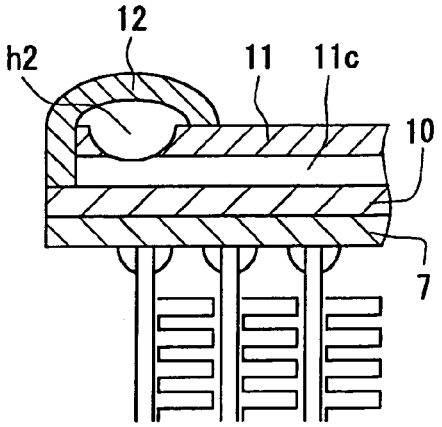

FIG. 8A is a partial perspective view illustrating another embodiment 4 of the refrigerant evaporator 1 of FIG. 1, FIG. 8B is a partial sectional view of the tank portion 11*a* vertically cut at the center thereof in FIG. 8A, FIG. 8C is a partial sectional view of the tank portion 11*b* vertically cut at the center thereof in FIG. 8A, and FIG. 8D is a partial sectional view of the tank portion 11*c* vertically cut at the center thereof in FIG. 8A. Holes h1, h2 are formed in the upper surfaces at the ends in the longitudinal direction of the tank portions 11*a*, 1*c* to be communicated among the tank portions 11*a* to 11*c* inside of the side tank 12, and the interior of the side tank 12 is communicated with the tank potions 11*a*, 11*c* through the holes h1, h2. No hole is formed in the tank portion 11*b* that is not to be communicated, and the end in the longitudinal direction thereof is brought into contact with the inner side surface of the side tank 12 to block the communication.

This also makes it possible to omit the separators 9*b* which are the constituent parts and, hence, to suppress the cost. Further, the ends of the tanks can be used for positioning the side tank 12 in the direction of width of the core portion and, besides, the holes h1, h2 can be easily perforated from the upper side by machining.

Another Embodiment 5

Figure 9:
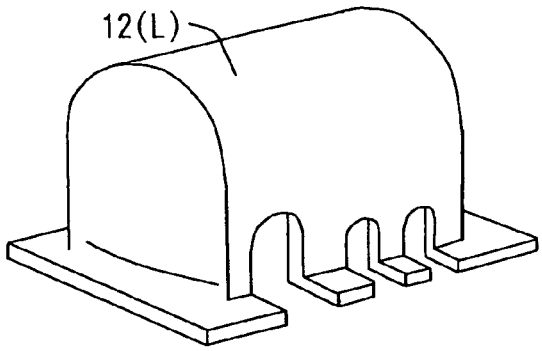
FIG. 9 is a partial perspective view illustrating another embodiment 5 of the refrigerant evaporator of FIG. 1.

FIG. 9 is a partial perspective view illustrating another embodiment 5 of the refrigerant evaporator 1 of FIG. 1. The side tank 12 is press-worked into nearly a semi-cylindrical shape. This makes it possible to omit the side caps 13 which are the constituent parts for sealing both ends of the side tank 12 in the axial direction and, hence, to suppress the cost. This further eliminates such an occurrence as a poor brazing or a missing part of the side caps 13.

Another Embodiment 6

Figure 10:
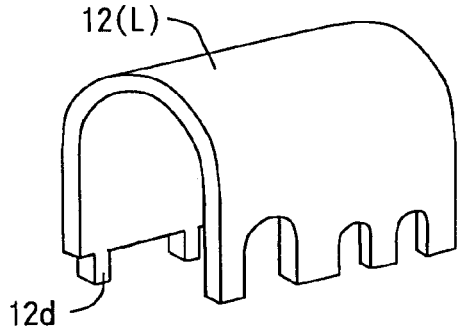
FIG. 10 is a partial perspective view illustrating another embodiment 6 of the refrigerant evaporator of FIG. 1.

FIG. 10 is a partial perspective view illustrating another embodiment 6 of the refrigerant evaporator 1 of FIG. 1. Pawls 12*d* are formed on the side tank 12 for caulking with other member. The pawls 12*d* facilitate the positioning of the side tank 12 in the direction of width of the core portion and prevent such an occurrence that the side caps 13 are defectively brazed or fall.

Another Embodiment 7

Figure 11:
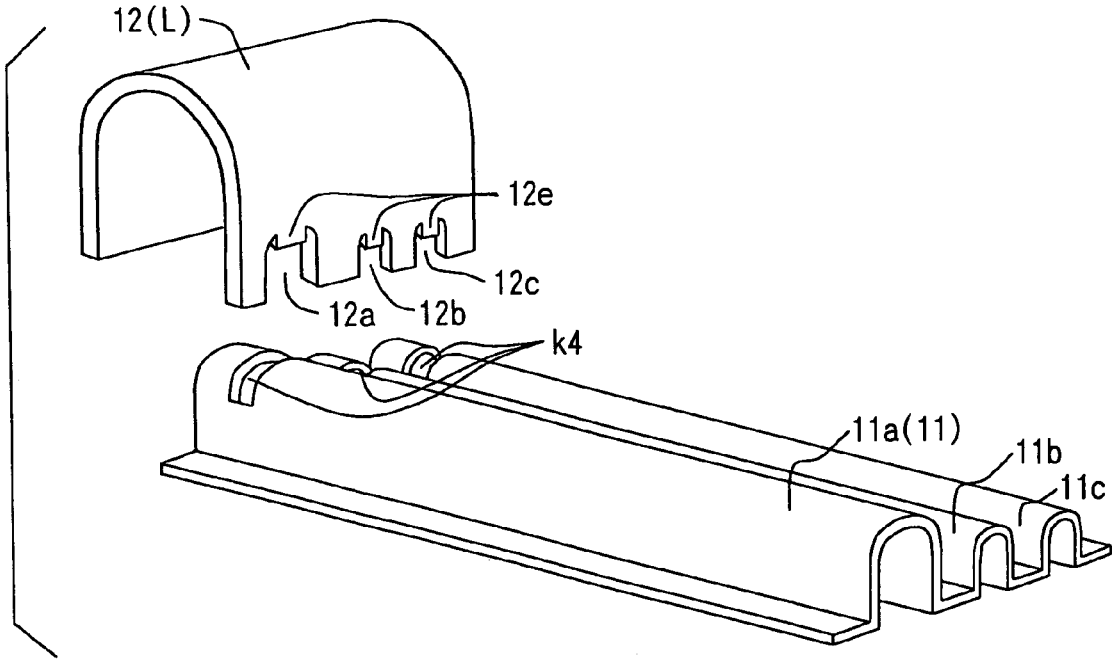
FIG. 11 is a partial perspective view illustrating another embodiment 7 of the refrigerant evaporator of FIG. 1.

FIG. 11 is a partial perspective view illustrating another embodiment 7 of the refrigerant evaporator 1 of FIG. 1. Cut portions k4 are formed in the ends in the longitudinal direction of the tank portions 11*a* to 11*c*, and pawls 12*e* are formed on the side tank 12 so as to be fitted to the cut portions k4. The cut portions k4 and the pawls 12*e* facilitate the positioning of the side tank 12 in the direction of width of the core portion. In the above embodiments 1 to 7, the same also applies to the right ends of the upper tank 2A that is not shown.

Another Embodiment 8

Figure 12:
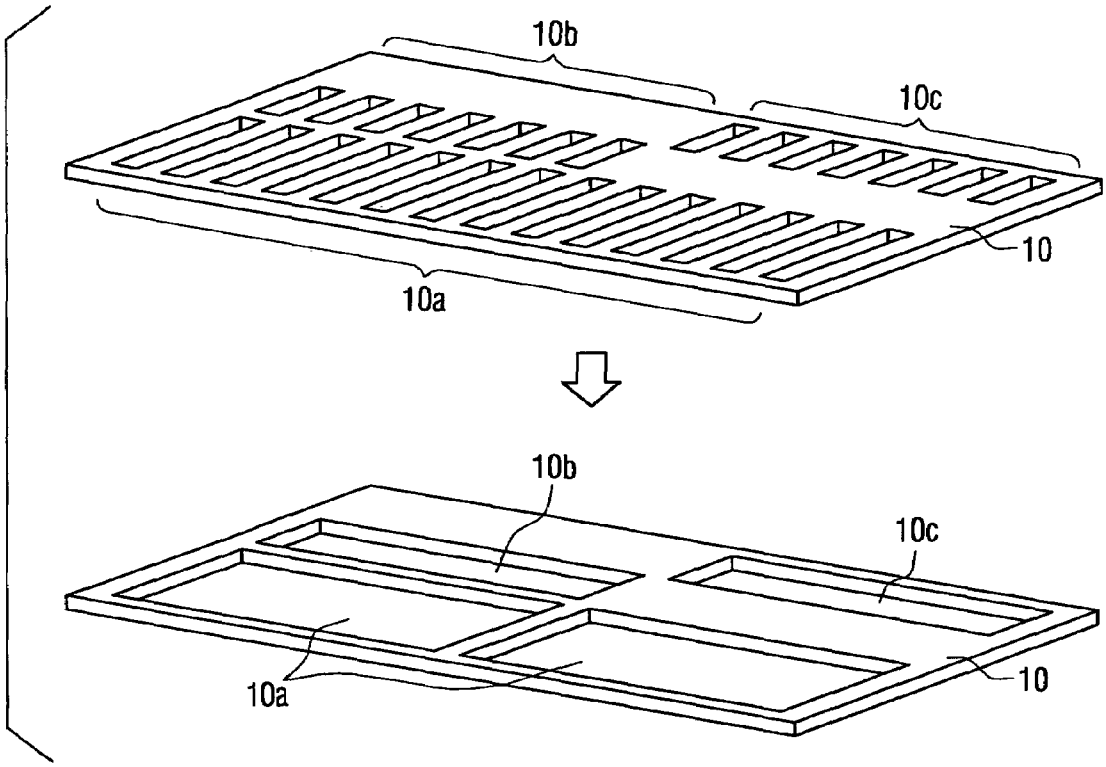
FIG. 12 is a partial perspective view illustrating another embodiment 8 of the refrigerant evaporator of FIG. 1.

FIG. 12 is a partial perspective view illustrating another embodiment 8 of the refrigerant evaporator 1 of FIG. 1. The communication holes 10*a* to 10*c* are formed in the distributing plate 10 in plural numbers so as to be corresponded to the first path portion 1P and the second path portion 2P. This can be applied to a heat exchanger that does not require much pressure resistance. The machinability for the distributing plate 10 can be enhanced to suppress the machining cost.

Another Embodiment 9

Figure 13:
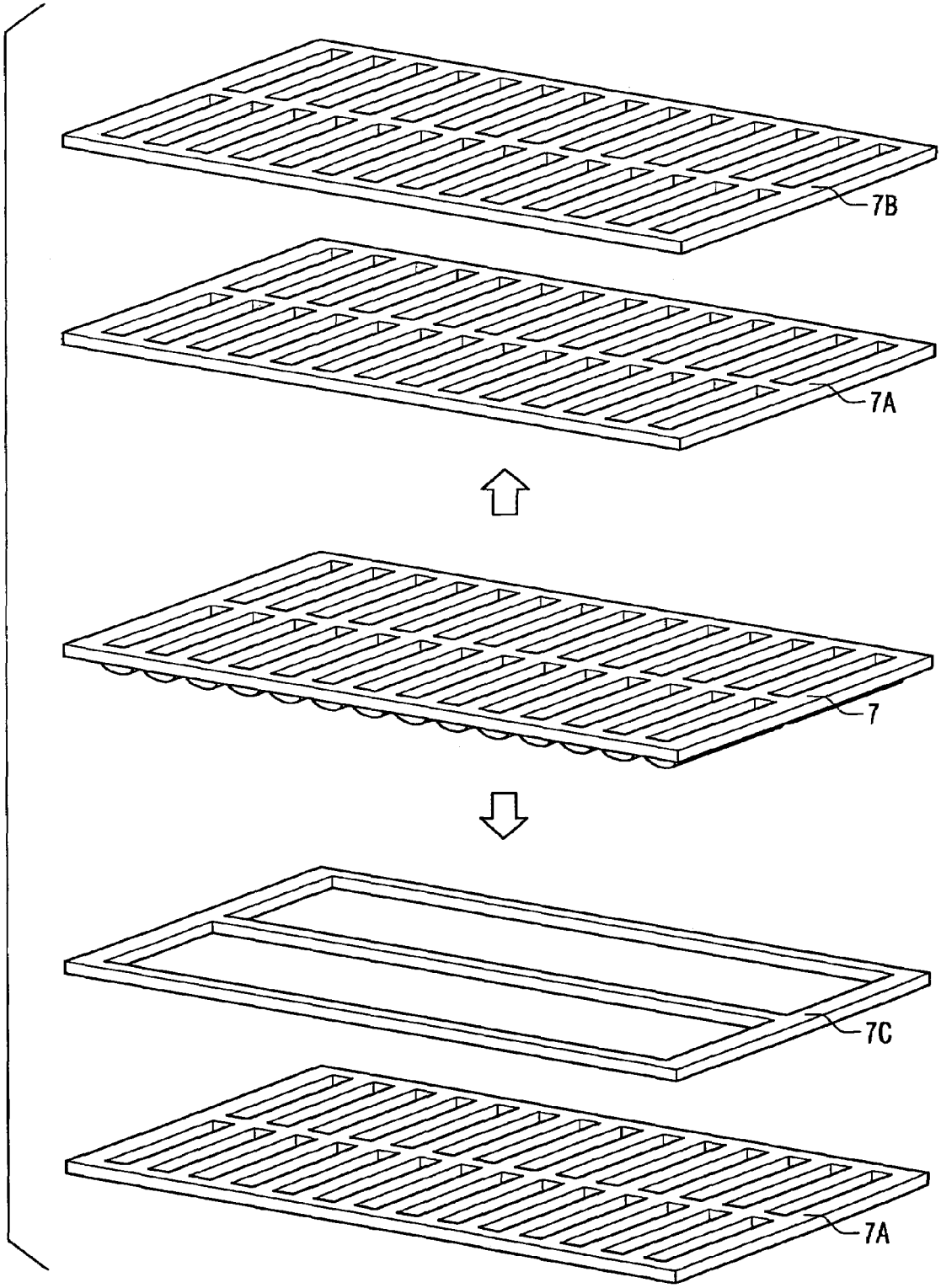
FIG. 13 is a partial perspective view illustrating another embodiment 9 of the refrigerant evaporator of FIG. 1.
Figure 14:
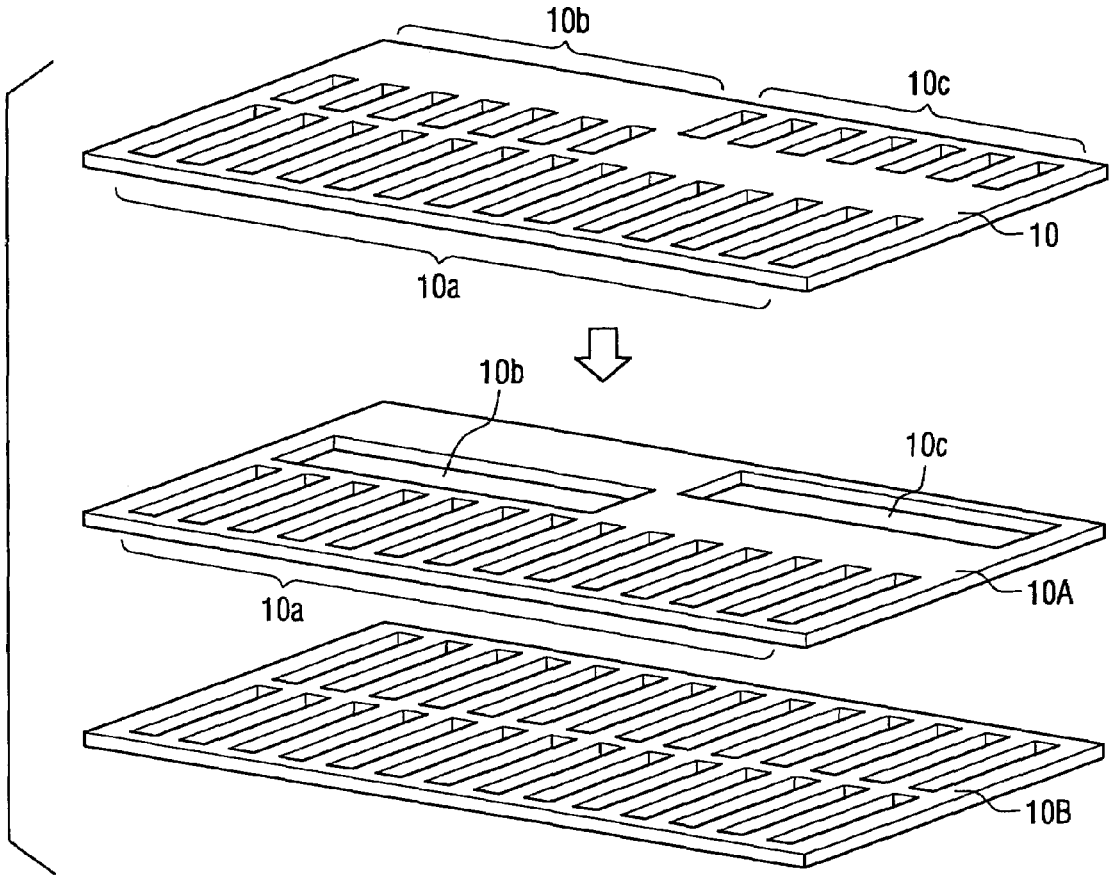
FIG. 14 is a partial perspective view illustrating a further embodiment of the refrigerant evaporator of FIG. 1.

FIG. 13 is a partial perspective view illustrating another embodiment 9 of the refrigerant evaporator 1 of FIG. 1. The header plate 7 is constituted being divided into a brazing function portion 7A relative to the tubes 4, and refrigerant collecting/distributing space function portions 7B, 7C relative to the tubes 4. This enhances the machinability for the header plate 7 to suppress the machining cost. Besides, the shape of the header plate 7 can be easily determined, the dispersion in the shape can be suppressed, and the pressure resistance can be easily maintained. FIG. 14 is a partial perspective view illustrating a further embodiment of the refrigerant evaporator 1 of FIG. 1. The distributing plates 10 may be used in a plural number as shown in FIG. 14.

Another Embodiment 10

Figure 15A:
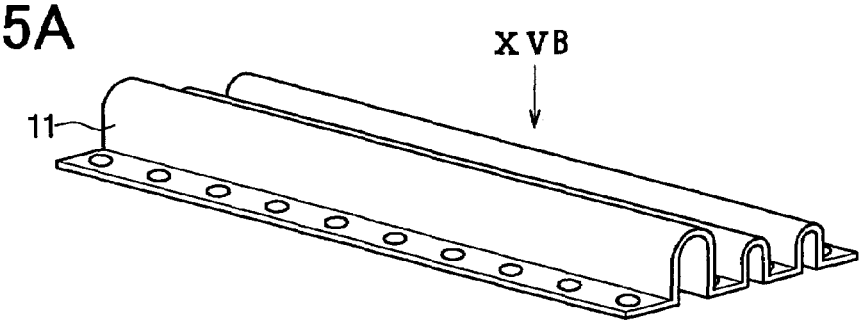
FIG. 15 is a partial perspective view illustrating another embodiment 10 of the refrigerant evaporator of FIG. 1.
FIG. 15B is a partial plan view of FIG. 15A as viewed from XVB.
Figure 15B:
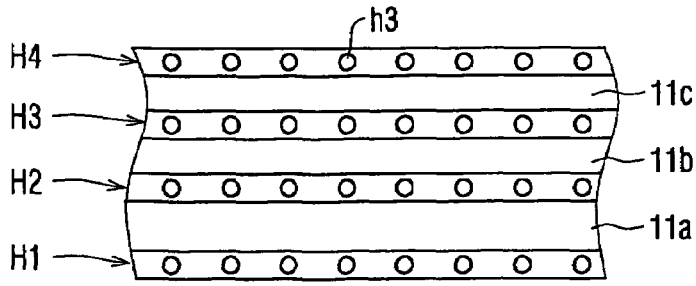

FIG. 15A is a partial perspective view illustrating another embodiment 10 of the refrigerant evaporator 1 of FIG. 1, and FIG. 15B is a partial plan view of FIG. 15A as viewed from XVB. In the plane brazing portions H1 to H4 between the header plate 7 and the distributing plate 10 or between the distributing plate 10 and the tank header plate 11, there are perforated small holes h3 in the plate 7, 10 or 11 of any side that is to be joined.

FIG. 15 illustrates an example of when the small holes h3 are perforated in the tank header plate 11. The small holes h3 are perforated among the tank portions 11*a* to 11*c* and on the outer sides thereof. The small holes h3 prevent the occurrence of voids, accelerate the brazing, and contribute to improving the quality of brazing and productivity. There is no limitation on the shape of the holes.

Second Embodiment

Figure 16:
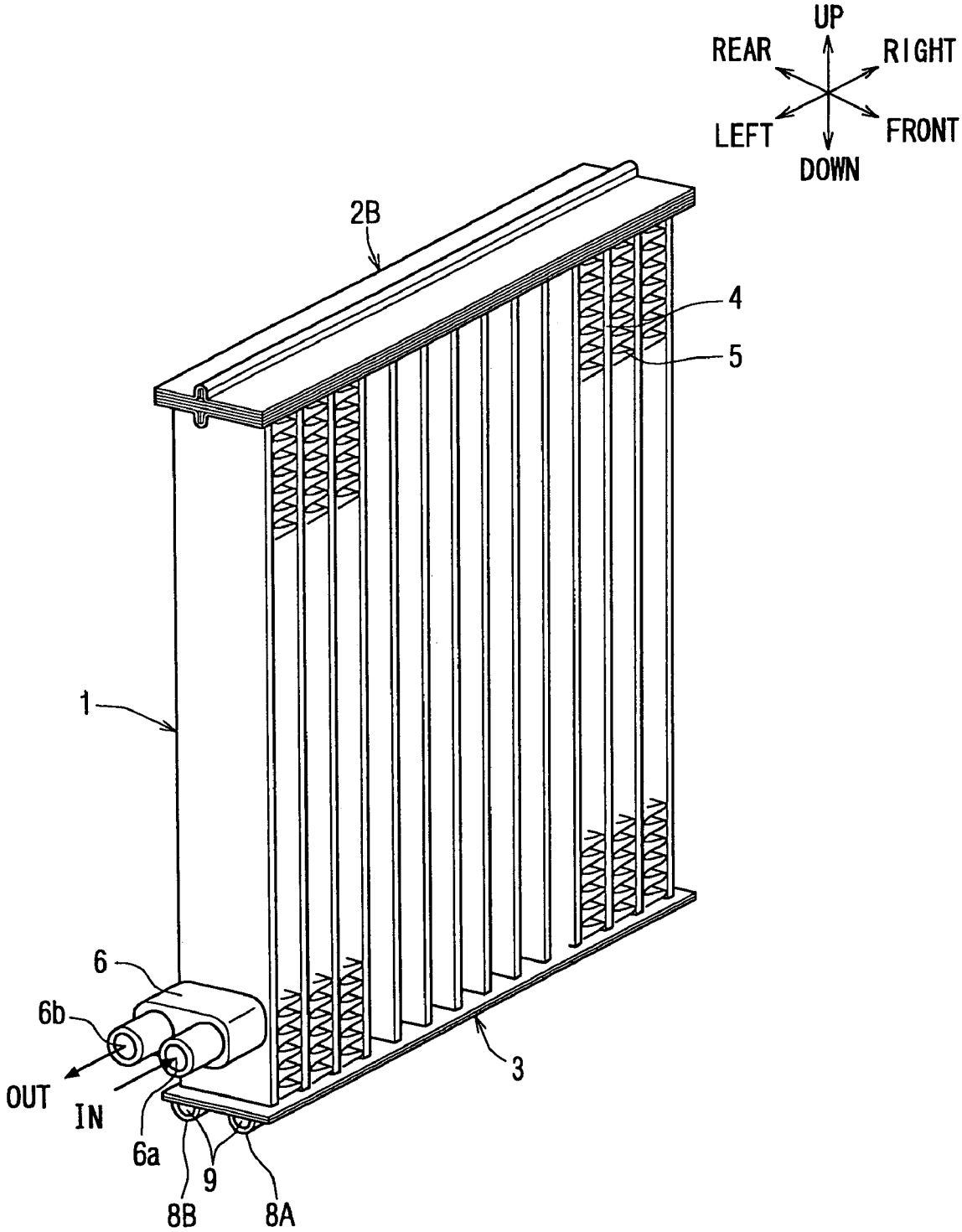
FIG. 16 is a perspective view of the refrigerant evaporator according to a second embodiment of the invention.
Figure 17:
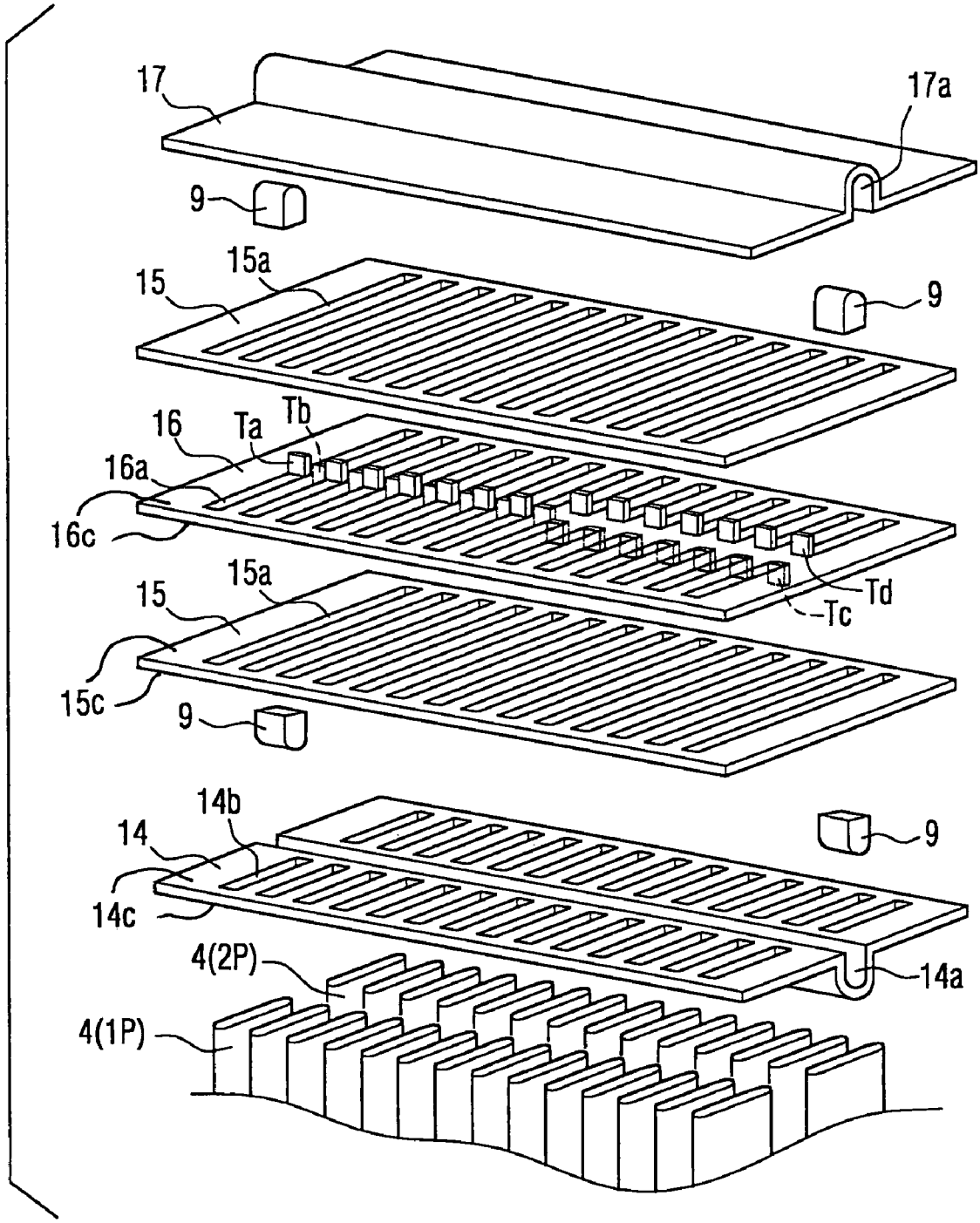
FIG. 17 is a perspective view illustrating, in a disassembled manner, the constitution of an upper tank portion in the refrigerant evaporator of FIG. 16.

FIG. 16 is a perspective view of the refrigerant evaporator 1 according to a second embodiment of the invention, and FIG. 17 is a perspective view illustrating, in a disassembled manner, the constitution of an upper tank portion 2B in the refrigerant evaporator 1 of FIG. 16. This embodiment is different from the above first embodiment in regard to the structure of the upper tank only. The same portions as those of the above embodiment are denoted by the same reference numerals, but their description is wholly or partly omitted.

The tank portion 2B of this embodiment is obtained by stacking, roughly on the core portion, a header plate 14, a space-forming plate 15, an intersecting plate 16, a space-forming plate 15 and a tank header plate 17. The tank header plate 17 is obtained by press-forming a plate member in a manner to form a line of tank portion 17*a* at the center. Header plate 14, space-forming plate 15 and intersecting plate 16 may constitute a double-sided clad member having brazing material 14*c*, 15*c* and 16*c*, respectively, clad onto their surfaces to facilitate brazing.

Similarly, the header plate 14, too, is obtained by press-forming a plate member in a manner to form a line of tank portion 14*a* at the center. Here, what makes the header plate 14 different from the tank header plate 17 is that tube holes 14*b* are perforated at the corresponding positions so that the tubes 4 can be connected thereto. The tank portions 14*a* and 17*a* constitute a pair of communication portions for communicating the first path portion 1P and the second path portion 2P with each other.

The space-forming plate 15 exhibits the refrigerant collecting/distributing space function, and is obtained by perforating, by presswork, space holes 15*a* in a plate member at positions corresponding to the tubes 4. The intersecting plate 16 forms flow passages by using the pair of communication portions 14*a* and 17*a* in a manner that the flow of the refrigerant passed through the first path portion 1P is changed over right side left as it is folded into the second path portion 2P. The communication holes 16*a* are perforated in the plate member at positions corresponding to the tubes 4, and erected portions that become the communication-blocking potions Ta to Td (see FIGS. 18B and 18C) are formed by press work at portions where the communication with the communicating portions 14*a*, 17*a* is to be blocked being corresponded to the front-and-rear right-and-left path portions.

Upon stacking them, there are formed the refrigerant collecting portions and the refrigerant distributing portions by using the space holes 15*a*, communication holes 16*a* and communication portions 14*a*, 17*a*. Caps 9 are arranged at both ends of the tank portions 14*a*, 17*a*. These parts are all formed by using aluminum and are integrally joined together by brazing.

Figure 18A:
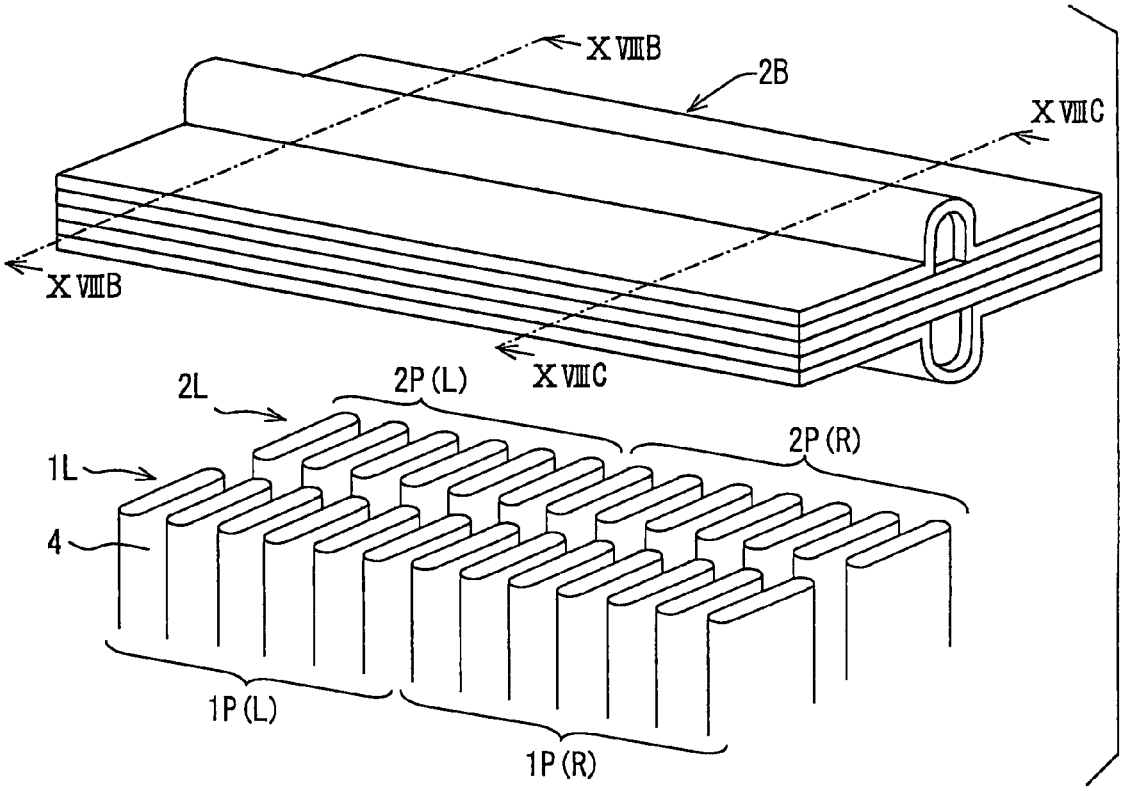
FIG. 18A is a perspective view of the upper tank portion of the refrigerant evaporator of FIG. 16.
Figure 18B:
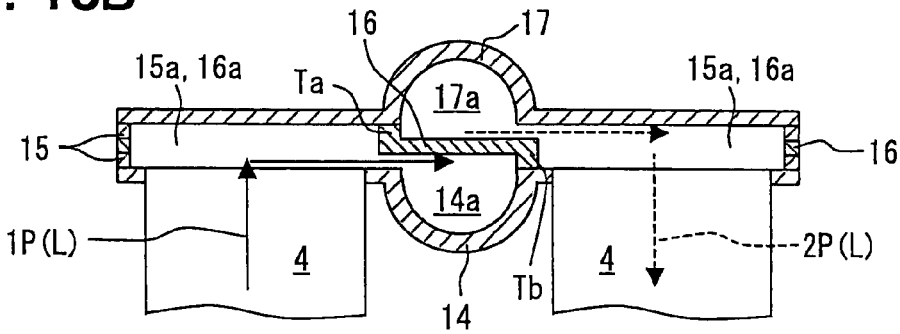
FIG. 18B is a sectional view along XVIIIB-XVIIIB in FIG. 18A.
Figure 18C:
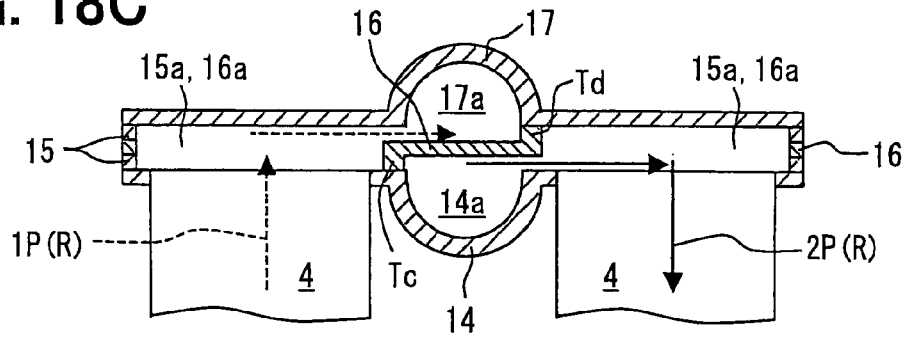
FIG. 18C is a sectional view along XVIIIC-XVIIIC in FIG. 18A.
Figure 19:
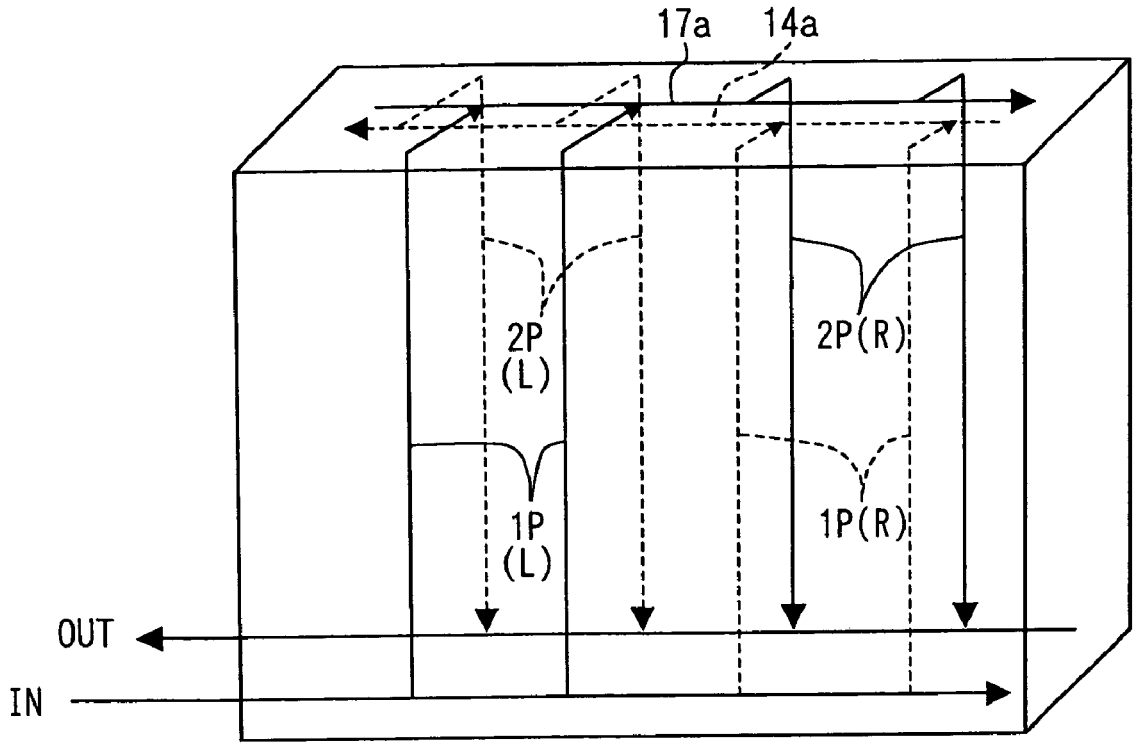
FIG. 19 is a view schematically illustrating the flow of the refrigerant in the refrigerant evaporator of FIG. 16.

Next described below is the flow of the refrigerant in the refrigerant evaporator 1 having the structure as described above. FIG. 18A is a perspective view of the upper tank portion 2B of the refrigerant evaporator 1 of FIG. 16, FIG., 18B is a sectional view along XVIIIB-XVIIIB in FIG. 18A, and FIG. 18C is a sectional view along XVIIIC-XVIIIC in FIG. 18A. FIG. 19 is a view schematically illustrating the flow of the refrigerant. In this embodiment, the flow of the refrigerant is changed over in the direction of width of the core in a manner as described below. The refrigerant (solid line arrows in FIG. 18B) collected in the tank portion 14*a* from the left row of the tubes of the front core portion 1P serving as the left first path 1P(L) through the front spaces 15*a*, 16*a*, flows toward the right in the tank portion 14*a*, flows into the right row of the tubes of the rear core portion 2P through the rear spaces 15*a*, 16*a*, and flows into the right second path 2P(R)(solid line arrows in FIG. 18C).

On the other hand, the refrigerant (dotted line arrows in FIG. 18B) collected in the tank portion 17*a* from the right row of the tubes of the front core portion 1P serving as the right first path 1P(R) through the front spaces 15*a*, 16*a*, flows toward the left in the tank portion 17*a*, flows into the left row of the tubes of the rear core portion 2P through the rear spaces 15*a*, 16*a*, and flows into the left second path 2P(L)(dotted line arrows in FIG. 18C). In the refrigerant evaporator 1 of this embodiment, the same flow passages are constituted irrespective of from which side the refrigerant is introduced like in the refrigerant evaporator 1 of the above first embodiment.

Next, described below are the feature and the effect of the embodiment. First, the refrigerant evaporator exchanges the heat between the air flowing through the outer portion and the refrigerant flowing through the inner portion. The flow of the refrigerant has at least the first path portion 1P and the second path portion 2P between the refrigerant inlet portion 6*a* and the refrigerant outlet portion 6*b*. The refrigerant evaporator includes a core portion formed by a row of the tubes 4 arranged in parallel, refrigerant collecting portions 15*a*, 16*a* where the refrigerant is collected flowing through the first path portion 1P, refrigerant distributing portions 15*a*, 16*a* for distributing the refrigerant to the second path portion 2P, and a pair of tank portions 14*a*, 17*a* for communicating the refrigerant collecting portions 15*a*, 16*a* with the refrigerant distributing portions 15*a*, 16*a*. The core portion has a first row 1L of the tubes and a second row 2L of the tubes on the front and rear sides, respectively, to form the first path portion 1P and the second path portion 2P on the right and left whole regions. The refrigerant collecting portions 15*a*, 16*a* and the refrigerant distributing portions 15*a*, 16*a* are divided to the right and the left, respectively, and the pair of tank portions 14*a* and 17*a* work to communicate the refrigerant collecting portions 15*a*, 16*a* with the refrigerant distributing portions 15*a*, 16*a* formed in separate regions from each other in terms of the right-and-left direction.

Namely, the tank portion 2B for changing over the flow of the refrigerant is constituted as the front-and-rear right-and-left cross path by laminating the header plate 14 and the tank header plate 17 forming the tank portions 14*a*, 17*a* as two flow passages in the vertical direction at right angles with the direction of air flow or with the direction in which the tubes are arranged in parallel, the space-forming plate 15 that forms the refrigerant collecting/distributing space for the tubes 4, and the distributing plate 16 having a separator function for guiding the refrigerant from the space-forming plate 15 to the two flow passages (tank portions 14*a*, 17*a*) ahead and a separator function for separating the two flow passages (tank portions 14*a*, 17*a*).

According to the above constitution, the number of the refrigerant flow corner portions is smaller than that in the refrigerant evaporator 1 of the first embodiment, and the lengths of the flow passages are short in the tank portions making it possible to decrease the pressure loss on the refrigerant side in the tanks and to improve performance.

Further, the refrigerant collecting portions 15*a*, 16*a*, the refrigerant distributing portions 15*a*, 16*a*, and the pair of tank portions 14*a*, 17*a*, are formed by laminating a header plate 14 for connecting the tubes 4 and having the tank portion 14*a*, the space-forming plate 15 exhibiting the refrigerant collecting/distributing space function, the intersecting plate 16 having communication-blocking portions Ta to Td for communicating the refrigerant collecting portions 15*a*, 16*a* with the refrigerant distributing portions 15*a*, 16*a* in a crossing manner, respectively, in the separate regions in the right-and-left direction, the space-forming plate 15, and the tank header plate 17 having the tank portion 17*a*. There is, thus, obtained a simple constitution that can be easily mass-produced.

Another Embodiment 11

Figure 20A:
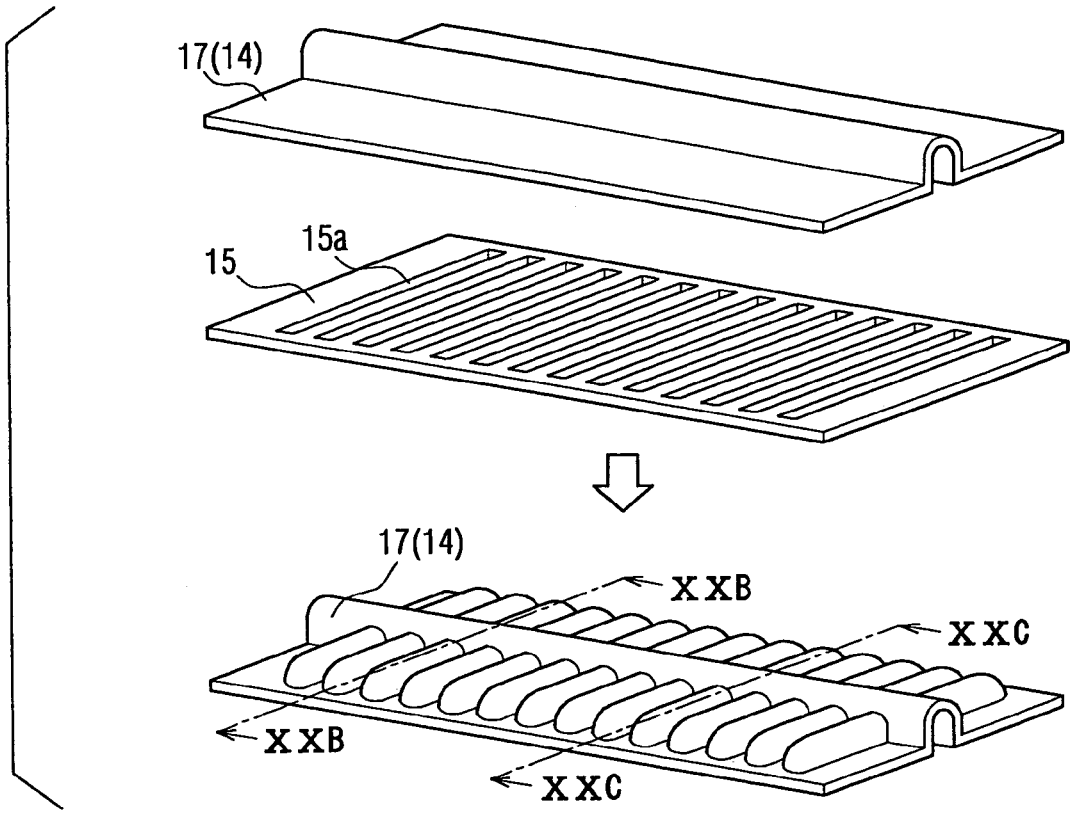
FIG. 20A is a perspective view illustrating another embodiment 11 of the refrigerant evaporator of FIG. 16.
Figure 20B:
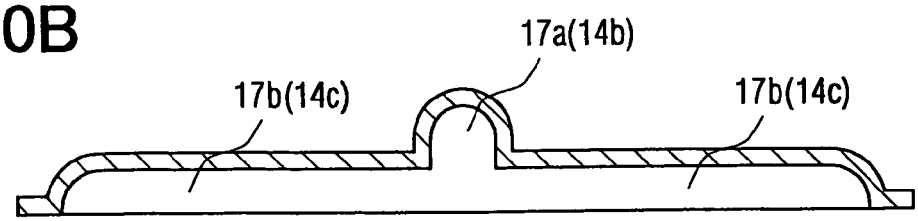
FIG. 20B is a sectional view along XXB-XXB in FIG. 20A.
Figure 20C:
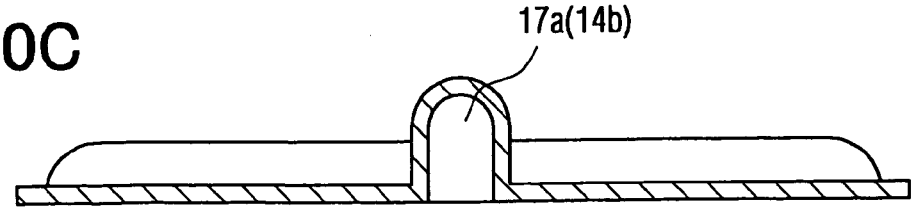
FIG. 20C is a sectional view along XXC-XXC in FIG. 20A.

FIG. 20A is a perspective view illustrating another embodiment 11 of the refrigerant evaporator 1 of FIG. 16, FIG. 20B is a sectional view along XXB-XXB in FIG. 20A, and FIG. 20C is a sectional view along XXC-XXC in FIG. 20A. Protuberances 14*c*, 17*b* corresponding to the tubes 4 are formed by press work on the header plate 14 and on the tank header plate 17 to impart thereto the refrigerant collecting/distributing space function exhibited by the space-forming plate 15. In practice, the ends of the communication-blocking portions Ta to TD erected on the intersecting plate 16 are formed in nearly an arcuate shape to meet thereto. This makes it possible to omit the space-forming plate 15 which is the constituent part, to reduce the weight as a result of using the material in decreased amounts, and to suppress the cost. Besides, the assembling is facilitated and the productivity is improved.

The tank header plate 17 illustrated in FIG. 20A includes trunk tank protuberances 17*a*, 14*b* and a plurality of branched tank protuberances 17*b*, 14*c*. The trunk tank protuberances 17*a*, 14*b* are protruded outward and forming grooves on the inside. The trunk tank protuberances 17*a*, 14*b* are extending in the longitudinal direction of the tank header plate 17. In this embodiment, the trunk tank protuberances 17*a*, 14*b* are provided at the center of the tank header plate 17. The trunk tank protuberances 17*a*, 14*b* provide passages for flowing the refrigerant in the longitudinal direction of the header plate 17, i.e., along the direction in which the tubes 4 are arranged. The branched tank protuberances 17*b*, 14*c* are arranged for the tubes 4. The branched tank protuberances 17*b*, 14*c* are extending in parallel with the ends of the flat tubes 4, and are extending along the longitudinal direction of the ends of the tubes 4. The branched tank protuberances 17*b*, 14*c* are formed on at least one side of the trunk tank protuberances 17*a*, 14*b* being arranged in parallel with each other along the direction in which the tubes 4 are arranged. In FIGS. 20A to 20C, the branched tank protuberances 17*b*, 14*c* are arranged on the right and/or left sides of the trunk tank protuberances 17*a*, 14*b*. The trunk tank protuberances 17*a*, 14*b* and the branched tank protuberances 17*b*, 14*c* are arranged like a skeleton of fish. The branched tank protuberances 17*b*, 14*c* are communicated at the ends on one side thereof with the trunk tank protuberances 17*a*, 14*b*. As a result, there are formed passages for communicating the openings at the ends of flat tubes 4 with the trunk tank protruded portions 17*a*, 14*b*. The branched tank protuberances 17*b*, 14*c* are formed like grooves with terminated ends on the side opposite to the trunk tank protuberances 17*a*, 14*b*. The branched tank protuberances 17*b*, 14*c* can be terminated even on the side of the trunk tank protuberances 17*a*, 14*b*. For example, the branched tank protuberances 17*b*, 14*c* can be terminated at portions where the communication blocking portions Ta, Td are to be formed. The ends of the branched tank protuberances 17*b*, 14*c* can be formed by partly crushing the bulging grooves illustrated in FIGS. 20A, 20B and 20C.

Figure 21:
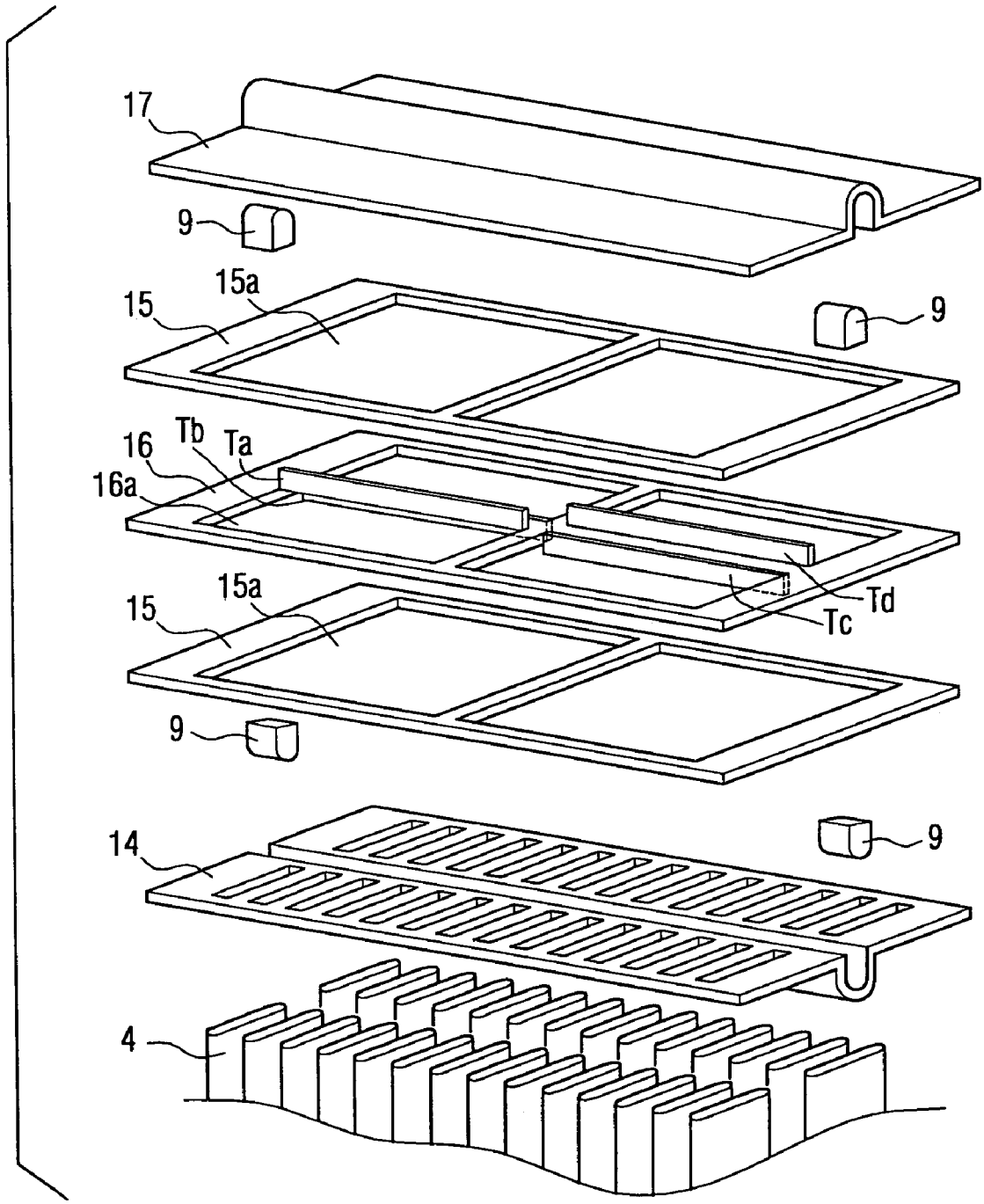
FIG. 21 is a perspective view illustrating, in a disassembled manner, the constitution of an embodiment 12 of the refrigerant evaporator of FIG. 16.

FIG. 21 is a perspective view illustrating, in a disassembled manner, the constitution of another embodiment 12 of the refrigerant evaporator 1 of FIG. 16. What makes a difference from the constitution of FIG. 17 is that the space holes 15*a* formed in the space-forming plate 15, the communication holes 16*a* formed in the intersecting plate 16 and the communication-blocking portions Ta to Td, are formed in large sizes being coupled together in plural numbers to meet the first path portion 1P and the second path portion 2P divided to the right and the left. This can be applied to a heat exchanger which does not much require the pressure resistance. Machinability for the space-forming plate 15 and for the intersecting plate 16 can be enhanced to suppress the machining cost.

Another Embodiment 13

Figure 22:
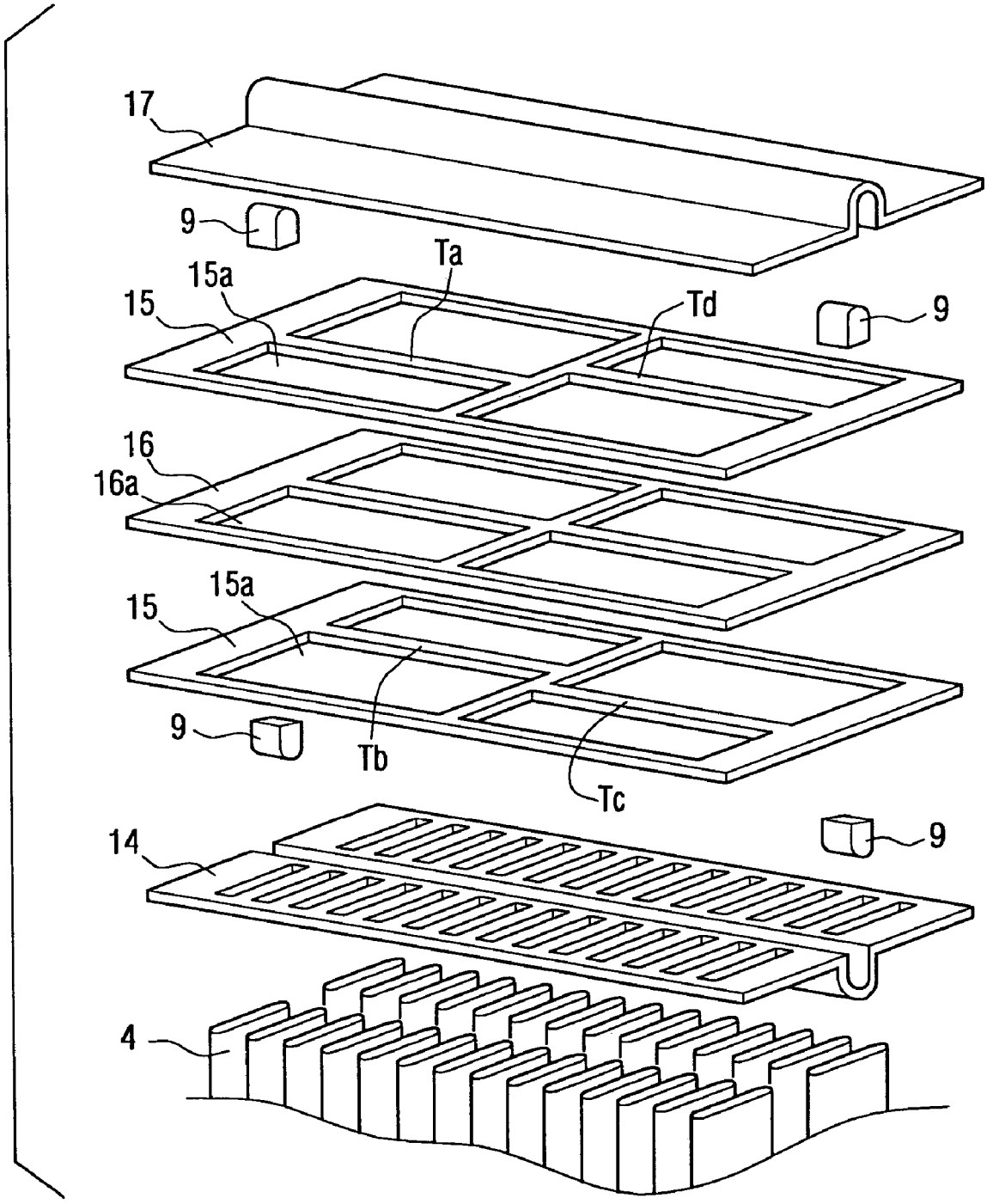
FIG. 22 is a perspective view illustrating, in a disassembled manner, the constitution of an embodiment 13 of the refrigerant evaporator of FIG. 16.

FIG. 22 is a perspective view illustrating, in a disassembled manner, the constitution of another embodiment 13 of the refrigerant evaporator 1 of FIG. 16. What makes a difference from the constitution of FIG. 17 is that the space holes 15*a* formed in the space-forming plate 15 and the communication holes 16*a* formed in the intersecting plate 16, are formed in large sizes being coupled together in plural numbers to meet the first path portion 1P and the second path portion 2P divided to the right and the left. Besides, the communication-blocking portions Ta to Td are formed in the space-forming plate 15 so that the intersecting plate 16 exhibits the function of a partitioning plate only. The above simplified shape facilitates the mass production.

Another Embodiment 14

Figure 23A:
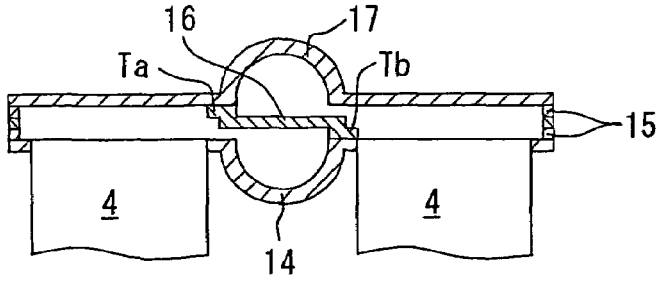
FIGS. 23A and 23B are partial sectional views illustrating another embodiment 14 of the refrigerant evaporator of FIG. 16.
Figure 23B:
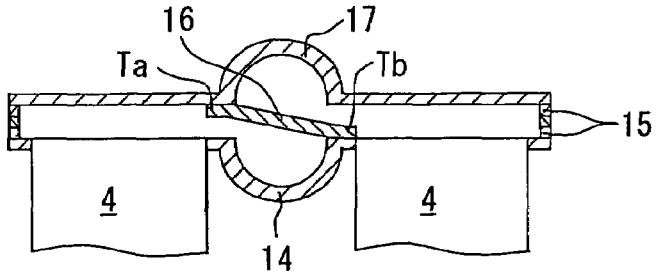

FIGS. 23A and 23B are partial sectional views illustrating another embodiment 14 of the refrigerant evaporator 1 of FIG. 16, and corresponds to the section XVIIIB-XVIIIB of FIG. 18. The communication-blocking portions Ta to Td formed on the intersecting plate 16 are brought into contact with the header plate 14 and with the tank header plate 17 on the front and back surfaces of the plate member forming the intersecting plate 16. The portions serving as partitioning plates of the intersecting plate 16 may assume a horizontal shape as shown in FIG. 23A or a tilted shape as shown in FIG. 23B. If a double-sided clad member is used as the intersecting plate 16, therefore, a further increased junction is realized to the two header plates 14, 17, and the brazing quality of the tank portions can be improved.

Another Embodiment 15

Figure 24A:
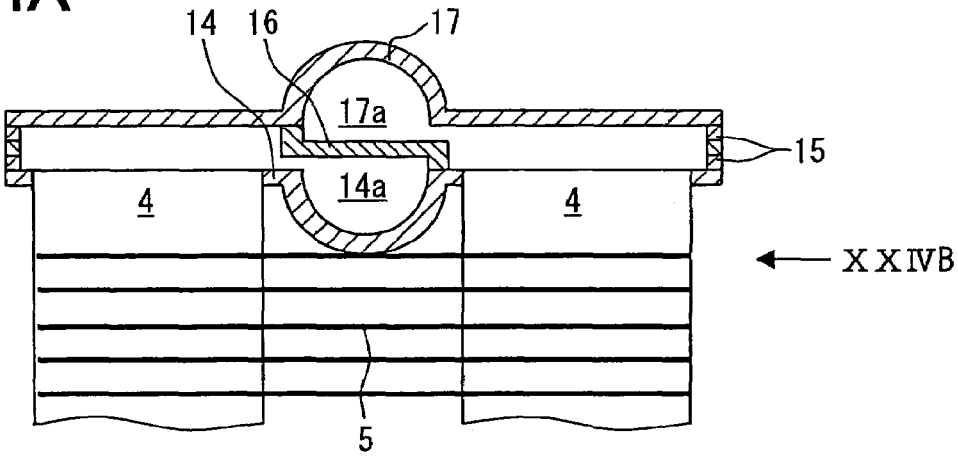
FIG. 24A is a perspective view illustrating an embodiment 15 of the refrigerant evaporator of FIG. 16.
Figure 24B:
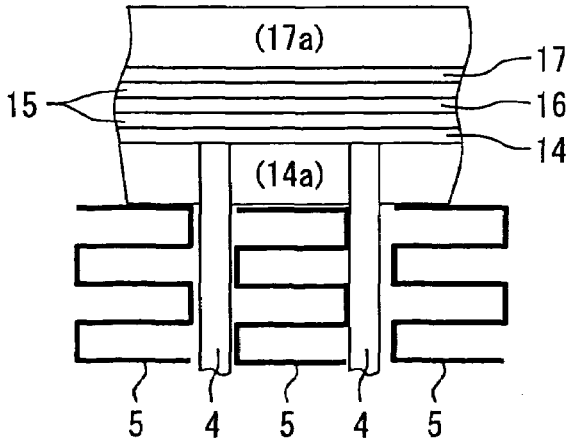
FIG. 24B is a partial side view of FIG. 24A as viewed from XXIVB.

FIG. 24A is a perspective view illustrating another embodiment 15 of the refrigerant evaporator 1 of FIG. 16, and FIG. 24B is a partial side view of FIG. 24A as viewed from XXIVB. The ends of fins 5 arranged among the tubes 4 are brought into contact with the outer surface of the tank portion 14*a* formed in the header plate 14.

So far, there existed a problem in that the tank portion has a curvature which is so large that the fins 5 come in surface contact with the surface of the tank causing the fins 5 to be melted. There further existed a problem in that the brazing material at the roots of the tubes 4 was pulled and a defective brazing was caused. So far, therefore, it was attempted to provide space between the tank surface and the fins 5. However, airflow resistance is small in space, and the air leaked from the space poses another problem of deteriorated heat-exchanging efficiency.

According to this embodiment, however, the tank protuberance has a small curvature, and there takes place a linear contact even if the fins 5 are brought into contact with the tank surface, and the fins are seldom melted. Besides, a distance is maintained from the roots of the tubes 4, and there occurs no defect at the roots. Further, no space exists between the tank surface and the fins 5, enhanced performance is obtained due to an increased heat-conducting area, and no air leaks from the above space suppressing a drop in the heat-exchanging efficiency. This further suppresses the generation of white mist which is a white vapor-like gas generated when the air that is not cooled comes in contact with the condensed water.

Another Embodiment 16

Figure 25:
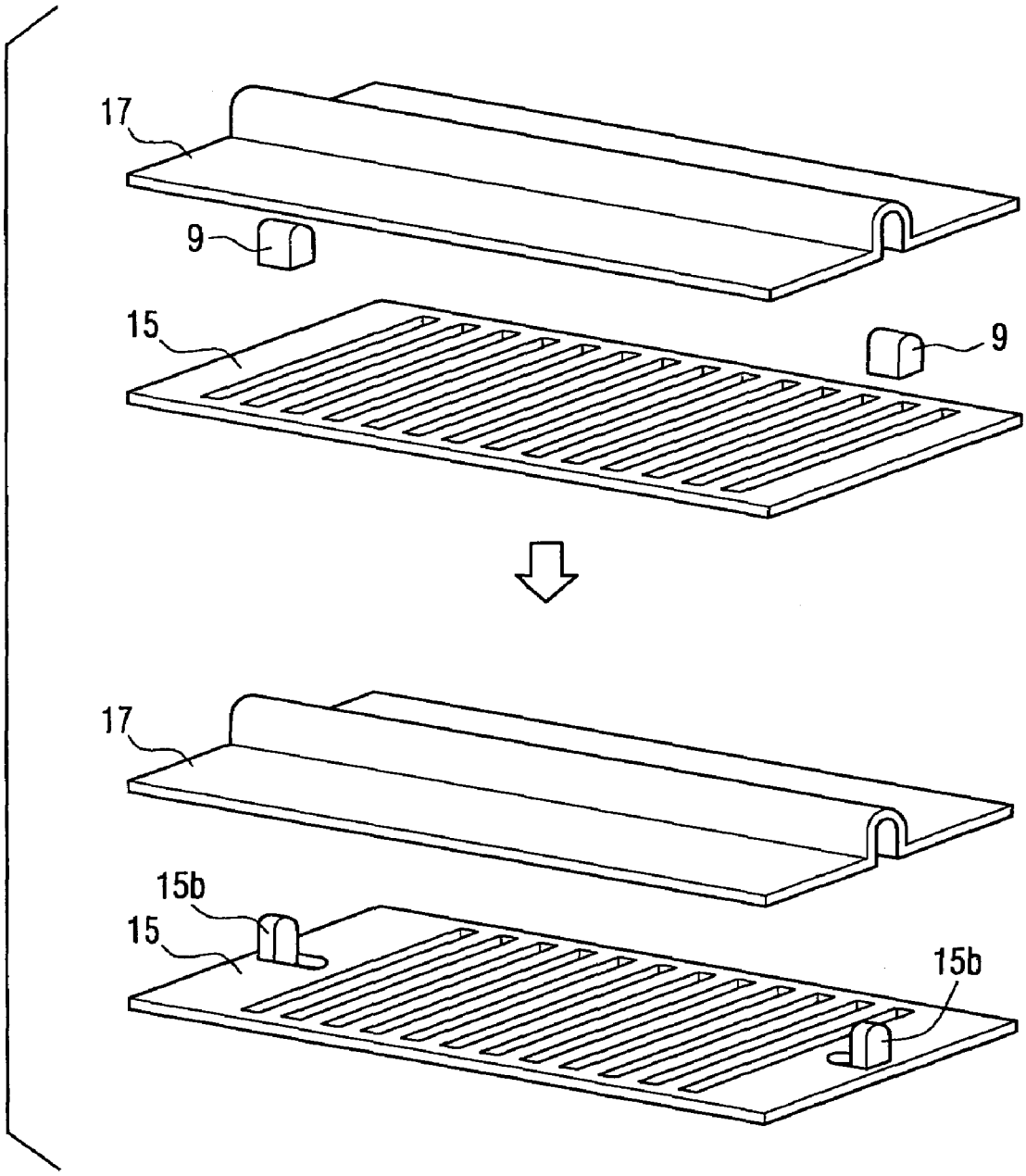
FIG. 25 is a perspective view illustrating another embodiment 16 of the refrigerant evaporator of FIG. 16.

FIG. 25 is a perspective view illustrating another embodiment 16 of the refrigerant evaporator 1 of FIG. 16. Erected portions 15*b* are formed in the space-forming plate 15 at both ends in the longitudinal direction thereof to seal both ends in the longitudinal direction of the tank portions 14*a*, 17*a*. This makes it possible to omit the caps 9 which are the constituent parts, to reduce the weight as a result of using the material in decreased amounts, and to suppress the cost. Besides, the assembling is facilitated and the productivity is improved.

Another Embodiment 17

Figure 26:
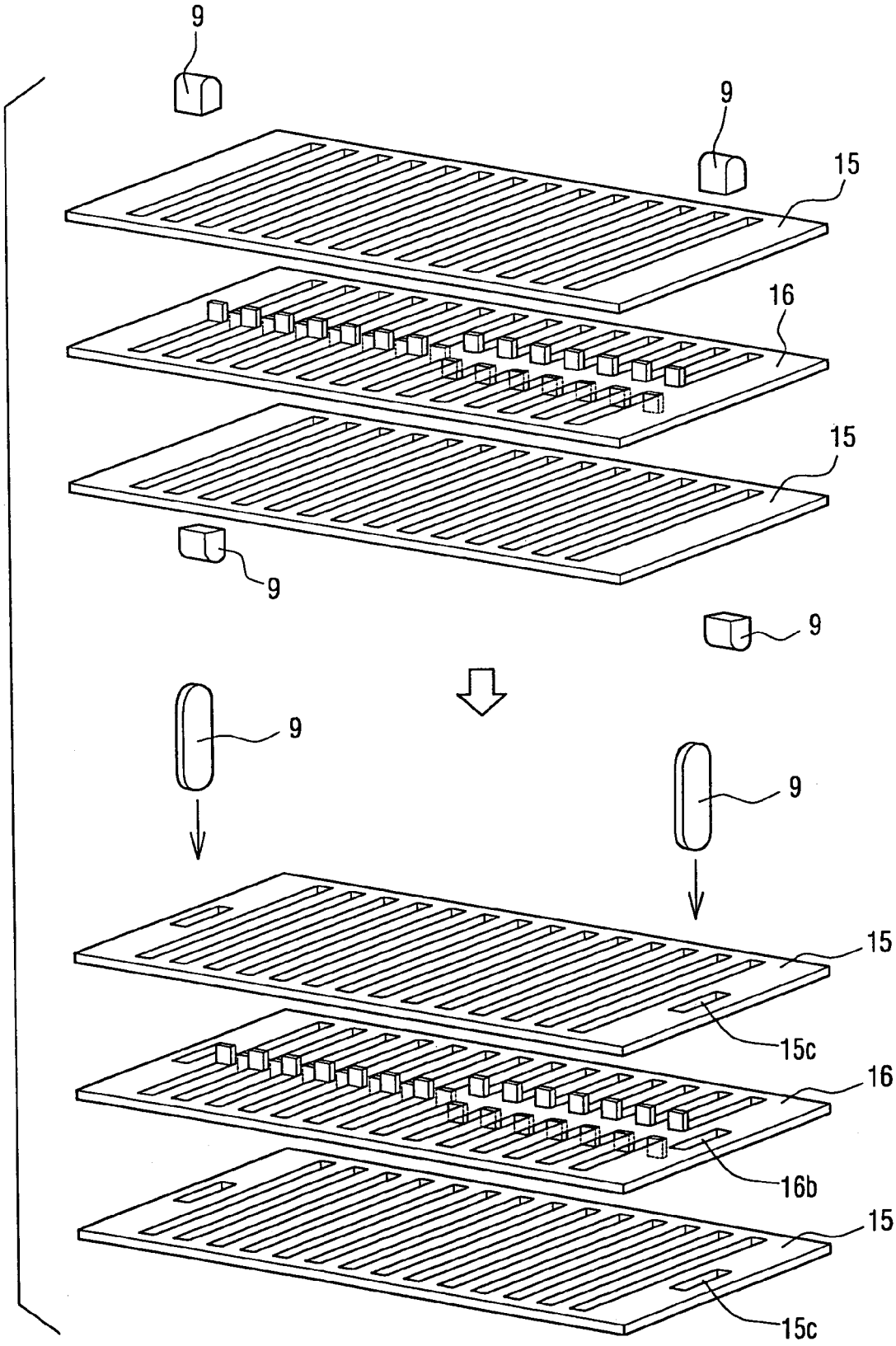
FIG. 26 is a perspective view illustrating another embodiment 17 of the refrigerant evaporator of FIG. 16.

FIG. 26 is a perspective view illustrating another embodiment 17 of the refrigerant evaporator 1 of FIG. 16. Narrow holes 15*c*, 16*b* are formed in the space-forming plate 15 and in the intersecting plate 16 at both ends in the longitudinal direction, and longitudinally elongated caps 9 are inserted in the narrow holes 15*c*, 16*b* to seal both ends in the longitudinal direction of the tank portions 14*a*, 17*a*. This makes it possible to omit the number of caps 9, to reduce the weight as a result of using the material in decreased amounts, and to suppress the cost. Besides, the caps 9 work as positioning parts for the space-forming plate 15 and the intersecting plate 16, facilitating the assembling and improving the productivity.

Another Embodiment 18

Figure 27A:
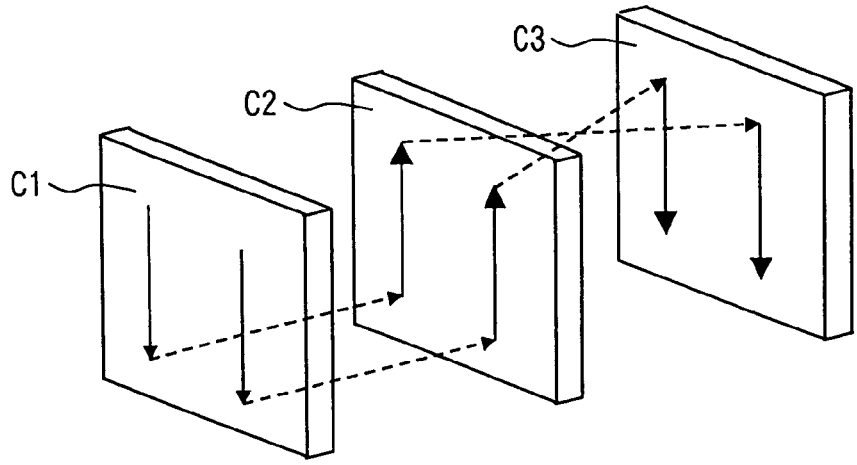
FIGS. 27A and 27B are views schematically illustrating another embodiment 18 of the refrigerant evaporator of FIGS. 1 and 16.
Figure 27B:
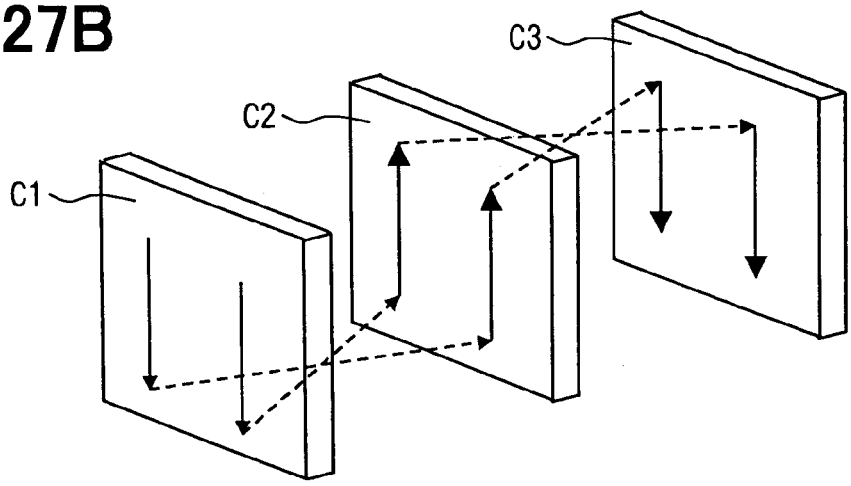

FIGS. 27A and 27B are views schematically illustrating another embodiment 18 of the refrigerant evaporator 1 of FIGS. 1 and 16. FIG. 27A illustrates a so-called front-and-back right-and-left cross path in which the refrigerant is crossed front and back, and right and left so as to be passed to different regions in the refrigerant evaporator having three or more rows of tubes, C1, C2, C3 in a direction in which the fluid to be cooled flows. Further, FIG. 27B illustrates a so-called front-and-back right-and-left cross path in which the refrigerant is crossed front and back, and right and left so as to be passed to different regions in the refrigerant evaporator having a plurality rows of tubes C1, C2, C3 in a direction in which the fluid to be cooled flows, the front-and-back right-and-left cross path being formed by the tubes 4 of the whole or part of the core surface.

According to this constitution, the portion of required performance only can be selected as the front-and-back right-and-left cross path to optimize the temperature distribution, and the tank structure, too, can be partly simplified. The effect increases with an increase in the number of the front-and-rear right-and-left cross paths.

Another Embodiment 19

Figure 28A:
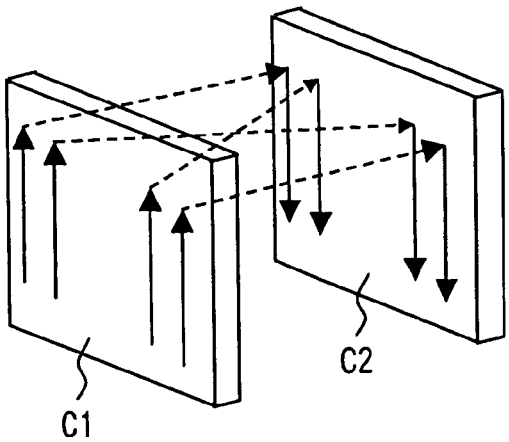
FIGS. 28A and 28B are views schematically illustrating another embodiment 19 of the refrigerant evaporator of FIGS. 1 and 16.
Figure 28B:
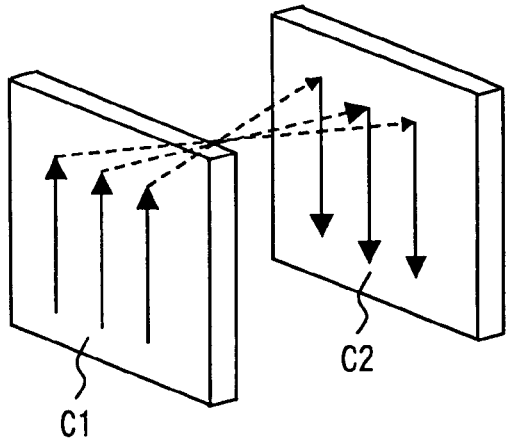

FIGS. 28A and 28B are views schematically illustrating another embodiment 19 of the refrigerant evaporator 1 of FIGS. 1 and 16. When some of the header plates 7, 14, distributing plate 10, tank header plates 11, 17, space-forming plate 15 and intersecting plate 16 are stacked and are bonded together by caulking, the caulking portions are arranged among the tubes 4. FIGS. 28A and 28B illustrate a so-called front and back right and left cross path in which the refrigerant is crossed front and back and right and left so as to be passed to different regions in the refrigerant evaporator having two rows of tubes C1, C2. The caulking work improves the productivity and, further, facilitates the positioning.

Another Embodiment 20

Figure 29A:
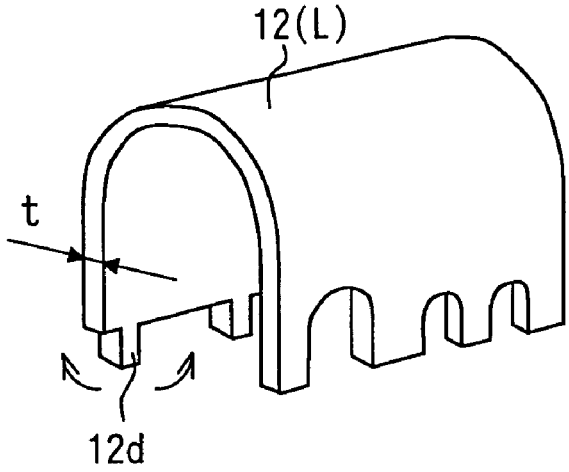
FIG. 29A is a perspective view of a side tank according to a third embodiment of the present invention.
Figure 29B:
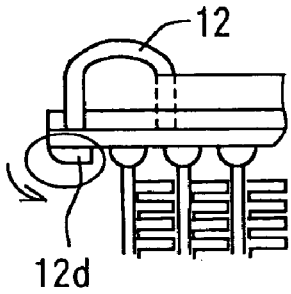
FIG. 29B PRIOR ART
FIG. 29B is a partial side view illustrating a conventional caulked state.
Figure 29C:
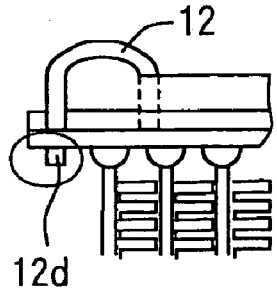
FIG. 29C is a partial side view illustrating a caulked state of the present invention.

FIG. 29A is a perspective view of a side tank 12 according to a third embodiment of the present invention, FIG. 29B is a partial side view illustrating a conventional caulked state, and FIG. 29C is a partial side view illustrating a caulked state according to the present invention. In the heat exchanger for exchanging the heat between the fluid flowing through the outer portion and the refrigerant flowing through the inner portion, the constituent member plates are bonded together by caulking. Here, the pawls 12*d* for caulking formed on the plate members are deformed in a direction at right angles with the direction of the thickness t of the plate members.

For example, when the constituent parts are to be assembled in the tank portion of the heat exchanger, it is a general practice to form the pawls for caulking on the parts to effect the bonding by caulking. In the heat exchanger that uses a carbon dioxide ($CO_2$) refrigerant of a high pressure, however, it is a tendency to design the parts constituting the tanks to possess an increased thickness for ensuring the resistance to pressure as compared to those used for the heat exchanger that uses a conventional freon (R134a) refrigerant. Due to the thick plate, therefore, only limited space for caulking is maintained as compared to the prior art. According to the present invention, therefore, the caulking pawls are folded in a direction at right angles with the direction of the plate thickness t though it is in the direction of the plate thickness t in the prior art.

This permits the pawls 12*d* to be deformed requiring a decreased working force and, further, makes it possible to maintain space for caulking. Further, the plate thickness t is utilized for the caulking width to easily obtain strength necessary for the bonding by caulking.

The Other Embodiment

The invention is not limited to the above embodiments only but can be variously applied within the scope set forth in claims. The above embodiments have dealt with the case of a supercritical refrigerating cycle by using the $CO_2$ refrigerant. The invention, however, is not to limit the kinds of the refrigerants or the refrigerant pressure, and may, further, be applied to the refrigerating cycle by using, for example, a freon refrigerant. Though the above embodiments have dealt with the refrigerant evaporator, the invention can be, further, applied to the case of heating a fluid that is to be heated by using a heat medium other than the refrigerant. In this case, the constitution becomes as described below.

A heat exchanger for exchanging the heat between a fluid of which the temperature to be controlled flowing through the outer portion and a heat medium flowing through the inner portion, wherein the flow of the heat medium includes:

at least a first path and a second path between a heat medium inlet portion and a heat medium outlet portion; and a core portion formed by a row of the tubes arranged in parallel, heat medium collecting portions where the heat medium is collected flowing through the first path, and heat medium distributing portions for distributing the heat medium to the second path. The core portion has a single row or a plurality of rows of the tubes that form the first path and the second path that flow in the opposite directions relative to each other on the right and left whole regions. The heat medium collecting portions have a structure to collect the heat medium in the first path in a manner of being divided to the right and the left, and the heat medium distributing portions have a structure for distribution in which the second path is formed in a region different from the first path in terms of the right-and-left direction. The heat medium collecting portions and the heat medium distributing portions are connected together through a pair of communication portions.

What is claimed is:

1. A refrigerant evaporator for exchanging heat between a fluid to be cooled flowing through an outer portion and a refrigerant flowing through an inner portion, the refrigerant evaporator comprising a first path portion and a second path portion extending between a refrigerant inlet portion and a refrigerant outlet portion;

a core portion formed by tubes arranged in parallel;

refrigerant collecting portions where the refrigerant is collected after flowing through said first path portion; and refrigerant distributing portions for distributing the refrigerant to said second path portion; wherein said core portion includes a first row of the tubes on a front side and a second row of the tubes on a rear side to form said first path portion and said second path portion on substantially a right and a left region;

said refrigerant collecting portions include a structure for collecting the refrigerant from said first path portion in a manner of being divided to the right region and the left region;

said refrigerant distributing portions are formed by a pair of tank portions disposed on the front side and the rear side, respectively, the refrigerant distributing portions have a structure in which said second path portion is formed in a region different from said first path portion in terms of a right-and-left direction;

said refrigerant collecting portions and said refrigerant distributing portions are connected together through a pair of communication members; and communication is blocked at portions where said tank portions are not to be in communication with interiors of said communication members by using side surfaces of said communication members.

2. A refrigerant evaporator according to claim 1, wherein said communication is blocked by providing a cut-away portion in the ends in the longitudinal direction of said tank portions that are not to be communicated with the interiors of said communication members, and by bringing the outer side surfaces of said communication members into contact with the end portions that have been cut away in the longitudinal direction.

3. A refrigerant evaporator according to claim 1, wherein said communication is blocked by providing a cut portion in the ends in the longitudinal direction of said tank portions that are not to be communicated with the interiors of said communication members, and by inserting side surfaces on one side of said communication members in the cut portions.

4. A refrigerant evaporator according to claim 1, wherein said communication is blocked by providing coincident cut portions in the ends in the longitudinal direction of said tank portions, inserting side surfaces on one side of said communication members in the cut portions, forming openings in said side surfaces at portions where the interiors of said communication member are to be communicated with the tank portions, and not forming said openings in the side surfaces of portions where the communication is not to be made.

5. A refrigerant evaporator according to claim 1, wherein holes are formed in the upper side of the ends in the longitudinal direction of the tank portions that are in said communication members, the interiors of said communication members are communicated with said tank portions through the holes, said holes are not formed in said tank portions that are not to be communicated, and said communication is blocked by bringing the ends in the longitudinal direction thereof into contact with the side surfaces on the inner side of said communication members.

6. A refrigerant evaporator for exchanging heat between a fluid to be cooled flowing through an outer portion and a refrigerant flowing through an inner portion, the refrigerant evaporator comprising a first path portion and a second path portion extending between a refrigerant inlet portion and a refrigerant outlet portion;

a core portion formed by tubes arranged in parallel;

refrigerant collecting portions where the refrigerant is collected after flowing through said first path portion; and refrigerant distributing portions for distributing the refrigerant to said second path portion; wherein said core portion includes a first row of the tubes on a front side and a second row of the tubes on a rear side to form said first path portion and said second path portion on substantially a right and a left region;

said refrigerant collecting portions include a structure for collecting the refrigerant from said first path portion in a manner of being divided to the right region and the left region;

said refrigerant distributing portions are formed by a pair of tank portions disposed on the front side and the rear side, respectively, the refrigerant distributing portions have a structure in which said second path portion is formed in a region different from said first path portion in terms of a right-and-left direction;

said refrigerant collecting portions and said refrigerant distributing portions are connected together through a pair of communication members; and said communication members having a substantially semi-cylindrical shape.

7. A refrigerant evaporator for exchanging heat between a fluid to be cooled flowing through an outer portion and a refrigerant flowing through an inner portion, the refrigerant evaporator comprising a first path portion and a second path portion extending between a refrigerant inlet portion and a refrigerant outlet portion;

a core portion formed by tubes arranged in parallel;

refrigerant collecting portions where the refrigerant is collected after flowing through said first path portion; and refrigerant distributing portions for distributing the refrigerant to said second path portion; wherein said core portion includes a first row of the tubes on a front side and a second row of the tubes on a rear side to form said first path portion and said second path portion on substantially a right and a left region;

said refrigerant collecting portions include a structure for collecting the refrigerant from said first path portion in a manner of being divided to the right region and the left region;

said refrigerant distributing portions are formed by a pair of tank portions disposed on the front side and the rear side, respectively, the refrigerant distributing portions have a structure in which said second path portion is formed in a region different from said first path portion in terms of a right-and-left direction;

said refrigerant collecting portions and said refrigerant distributing portions are connected together through a pair of communication members; and pawls are formed on said communication members for coupling with other members by caulking.

8. A refrigerant evaporator for exchanging heat between a fluid to be cooled flowing through an outer portion and a refrigerant flowing through an inner portion, the refrigerant evaporator comprising a first path portion and a second path portion extending between a refrigerant inlet portion and a refrigerant outlet portion;

a core portion formed by tubes arranged in parallel;

refrigerant collecting portions where the refrigerant is collected after flowing through said first path portion; and refrigerant distributing portions for distributing the refrigerant to said second path portion; wherein said core portion includes a first row of the tubes on a front side and a second row of the tubes on a rear side to form said first path portion and said second path portion on substantially a right and a left region;

said refrigerant collecting portions include a structure for collecting the refrigerant from said first path portion in a manner of being divided to the right region and the left region;

said refrigerant distributing portions are formed by a pair of tank portions disposed on the front side and the rear side, respectively, the refrigerant distributing portions have a structure in which said second path portion is formed in a region different from said first path portion in terms of a right-and-left direction;

said refrigerant collecting portions and said refrigerant distributing portions are connected together through a pair of communication members; and cut portions are formed in the ends in the longitudinal direction of the tank portions, and pawls are formed on said communication members so as to be fitted to said cut portions.

9. A refrigerant evaporator for exchanging heat between a fluid to be cooled flowing through an outer portion and a refrigerant flowing through an inner portion, the refrigerant evaporator comprising a first path portion and a second path portion extending between a refrigerant inlet portion and a refrigerant outlet portion;

a core portion formed by tubes arranged in parallel;

refrigerant collecting portions where the refrigerant is collected after flowing through said first path portion; and refrigerant distributing portions for distributing the refrigerant to said second path portion; wherein said core portion includes a first row of the tubes on a front side and a second row of the tubes on a rear side to form said first path portion and said second path portion on substantially a right and a left region;

said refrigerant collecting portions include a structure for collecting the refrigerant from said first path portion in a manner of being divided to the right region and the left region;

said refrigerant distributing portions are formed by a pair of tank portions disposed on the front side and the rear side, respectively, the refrigerant distributing portions have a structure in which said second path portion is formed in a region different from said first path portion in terms of a right-and-left direction;

said refrigerant collecting portions and said refrigerant distributing portions are connected together through a pair of communication members; and said refrigerant collecting portions and said refrigerant distributing portions are formed by stacking a header plate for connecting said tubes, a tank header plate forming the tank portions integrally together, and a distributing plate disposed therebetween and forming communication holes for communicating said tubes with said tank portions; and said communication holes are formed in said distributing plate being coupled together in a plural number so as to be corresponded to said first path portion and said second path portion divided to the right and the left.

10. A refrigerant evaporator for exchanging heat between a fluid to be cooled flowing through an outer portion and a refrigerant flowing through an inner portion, the refrigerant evaporator comprising a first path portion and a second path portion extending between a refrigerant inlet portion and a refrigerant outlet portion;

a core portion formed by tubes arranged in parallel;

refrigerant collecting portions where the refrigerant is collected after flowing through said first path portion; and refrigerant distributing portions for distributing the refrigerant to said second path portion; wherein said core portion includes a first row of the tubes on a front side and a second row of the tubes on a rear side to form said first path portion and said second path portion on substantially a right and a left region;

said refrigerant collecting portions include a structure for collecting the refrigerant from said first path portion in a manner of being divided to the right region and the left region;

said refrigerant distributing portions are formed by a pair of tank portions disposed on the front side and the rear side, respectively, the refrigerant distributing portions have a structure in which said second path portion is formed in a region different from said first path portion in terms of a right-and-left direction;

said refrigerant collecting portions and said refrigerant distributing portions are connected together through a pair of communication members; and said refrigerant collecting portions and said refrigerant distributing portions are formed by stacking a header plate for connecting said tubes, a tank header plate forming the tank portions integrally together, and a distributing plate disposed therebetween and forming communication holes for communicating said tubes with said tank portions; and said header plate is constituted being divided into a functional portion for brazing to said tubes, and refrigerant collecting/distributing space functional portions to said tubes.

11. A refrigerant evaporator for exchanging heat between a fluid to be cooled flowing through an outer portion and a refrigerant flowing through an inner portion, the refrigerant evaporator comprising a first path portion and a second path portion extending between a refrigerant inlet portion and a refrigerant outlet portion;

a core portion formed by tubes arranged in parallel;

refrigerant collecting portions where the refrigerant is collected after flowing through said first path portion; and refrigerant distributing portions for distributing the refrigerant to said second path portion; wherein said core portion includes a first row of the tubes on a front side and a second row of the tubes on a rear side to form said first path portion and said second path portion on substantially a right and a left region; said refrigerant collecting portions include a structure for collecting the refrigerant from said first path portion in a manner of being divided to the right region and the left region;

said refrigerant distributing portions are formed by a pair of tank portions disposed on the front side and the rear side, respectively, the refrigerant distributing portions have a structure in which said second path portion is formed in a region different from said first path portion in terms of a right-and-left direction;

said refrigerant collecting portions and said refrigerant distributing portions are connected together through a pair of communication members; and said refrigerant collecting portions and said refrigerant distributing portions are formed by stacking a header plate for connecting said tubes, a tank header plate forming the tank portions integrally together, and a distributing plate disposed therebetween and forming communication holes for communicating said tubes with said tank portions; and small holes are perforated in any one of the plates of the side that is to be joined in the flat brazing portions between said header plate and said distributing plate or between said distributing plate and said tank header plate.

12. A refrigerant evaporator for exchanging heat between a fluid to be cooled flowing through an outer portion and a refrigerant flowing through an inner portion, the refrigerant evaporator comprising:

a first path portion and a second path portion extending between a refrigerant inlet portion and a refrigerant outlet portion;

a core portion formed by the tubes arranged in parallel;

refrigerant collecting portions where the refrigerant is collected after flowing through said first path portion;

refrigerant distributing portions for distributing the refrigerant to said second path portion; and a pair of tank portions for communicating said refrigerant collecting portions with said refrigerant distributing portions; wherein said core portion includes a first row of the tubes and a second row of the tubes to form said first path portion and said second path portion on a right and a left region;

said refrigerant collecting portions and said refrigerant distributing portions are divided to the right and the left region, respectively;

said pair of tank portions communicate said refrigerant collecting portions with said refrigerant distributing portions, said pair of tank portions being in a right-and-left direction;

said refrigerant collecting portions, said refrigerant distributing portions and said pair of tank portions are formed by laminating a first header plate for connecting said tubes and having said tank portion, a first space-forming plate that exhibits a refrigerant collecting/distributing space function, an intersecting plate having communication-blocking portions for communicating said refrigerant collecting portions with said refrigerant distributing portions, said communication-blocking portions being in the right-and-left direction, in an intersecting manner, a second space-forming plate and a second tank header plate that has said tank portion; and protuberances corresponding to said tubes are formed on said header plate and on said tank header plate to impart thereto the refrigerant collecting/distributing space function exhibited by said space-forming plate.

13. A refrigerant evaporator for exchanging heat between a fluid to be cooled flowing through an outer portion and a refrigerant flowing through an inner portion, the refrigerant evaporator comprising:

a first path portion and a second path portion extending between a refrigerant inlet portion and a refrigerant outlet portion;

a core portion formed by the tubes arranged in parallel;

refrigerant collecting portions where the refrigerant is collected after flowing through said first path portion;

refrigerant distributing portions for distributing the refrigerant to said second path portion; and a pair of tank portions for communicating said refrigerant collecting portions with said refrigerant distributing portions; wherein said core portion includes a first row of the tubes and a second row of the tubes to form said first path portion and said second path portion on a right and a left region;

said refrigerant collecting portions and said refrigerant distributing portions are divided to the right and the left region, respectively;

said pair of tank portions communicate said refrigerant collecting portions with said refrigerant distributing portions, said pair of tank portions being in a right-and-left direction;

said refrigerant collecting portions, said refrigerant distributing portions and said pair of tank portions are formed by laminating a first header plate for connecting said tubes and having said tank portion, a first space-forming plate that exhibits a refrigerant collecting/distributing space function, an intersecting plate having communication-blocking portions for communicating said refrigerant collecting portions with said refrigerant distributing portions, said communication-blocking portions being in the right-and-left direction, in an intersecting manner, a second space-forming plate and a second tank header plate that has said tank portion; and space holes in said space-forming plate, communication holes in said intersecting plate and said communication-blocking portions are formed in plural numbers being coupled together and in large sizes being corresponded to said first path portion and said second path portion divided to the right and the left.

14. A refrigerant evaporator for exchanging heat between a fluid to be cooled flowing through an outer portion and a refrigerant flowing through an inner portion, the refrigerant evaporator comprising:

a first path portion and a second path portion extending between a refrigerant inlet portion and a refrigerant outlet portion;

a core portion formed by the tubes arranged in parallel;

refrigerant collecting portions where the refrigerant is collected after flowing through said first path portion;

refrigerant distributing portions for distributing the refrigerant to said second path portion; and a pair of tank portions for communicating said refrigerant collecting portions with said refrigerant distributing portions; wherein said core portion includes a first row of the tubes and a second row of the tubes to form said first path portion and said second path portion on a right and a left region;

said refrigerant collecting portions and said refrigerant distributing portions are divided to the right and the left region, respectively;

said pair of tank portions communicate said refrigerant collecting portions with said refrigerant distributing portions, said pair of tank portions being in a right-and-left direction;

said refrigerant collecting portions, said refrigerant distributing portions and said pair of tank portions are formed by laminating a first header plate for connecting said tubes and having said tank portion, a first space-forming plate that exhibits a refrigerant collecting/distributing space function, an intersecting plate having communication-blocking portions for communicating said refrigerant collecting portions with said refrigerant distributing portions, said communication-blocking portions being in the right-and-left direction, in an intersecting manner, a second space-forming plate and a second tank header plate that has said tank portion; and space holes in said space-forming plate and communication holes in said intersecting plate are formed in plural numbers being coupled together and in large sizes being corresponded to said first path portion and said second path portion divided to the right and the left, and said communication-blocking portions are formed on said space-forming plate so that said intersecting plate exhibits the function of a partitioning plate only.

15. A refrigerant evaporator for exchanging heat between a fluid to be cooled flowing through an outer portion and a refrigerant flowing through an inner portion, the refrigerant evaporator comprising:

a first path portion and a second path portion extending between a refrigerant inlet portion and a refrigerant outlet portion;

a core portion formed by the tubes arranged in parallel;

refrigerant collecting portions where the refrigerant is collected after flowing through said first path portion;

refrigerant distributing portions for distributing the refrigerant to said second path portion; and a pair of tank portions for communicating said refrigerant collecting portions with said refrigerant distributing portions; wherein said core portion includes a first row of the tubes and a second row of the tubes to form said first path portion and said second path portion on a right and a left region;

said refrigerant collecting portions and said refrigerant distributing portions are divided to the right and the left region, respectively;

said pair of tank portions communicate said refrigerant collecting portions with said refrigerant distributing portions, said pair of tank portions being in a right-and-left direction;

said refrigerant collecting portions, said refrigerant distributing portions and said pair of tank portions are formed by laminating a first header plate for connecting said tubes and having said tank portion, a first space-forming plate that exhibits a refrigerant collecting/distributing space function, an intersecting plate having communication-blocking portions for communicating said refrigerant collecting portions with said refrigerant distributing portions, said communication-blocking portions being in the right-and-left direction, in an intersecting manner, a second space-forming plate and a second tank header plate that has said tank portion; and the communication-blocking portions formed on said intersecting plate are brought into contact with said header plate and with said tank header plate on the front and back surfaces of the plate member forming said intersecting plate.

16. A refrigerant evaporator for exchanging heat between a fluid to be cooled flowing through an outer portion and a refrigerant flowing through an inner portion, the refrigerant evaporator comprising:

a first path portion and a second path portion extending between a refrigerant inlet portion and a refrigerant outlet portion;

a core portion formed by the tubes arranged in parallel;

refrigerant collecting portions where the refrigerant is collected after flowing through said first path portion;

refrigerant distributing portions for distributing the refrigerant to said second path portion; and a pair of tank portions for communicating said refrigerant collecting portions with said refrigerant distributing portions; wherein said core portion includes a first row of the tubes and a second row of the tubes to form said first path portion and said second path portion on a right and a left region;

said refrigerant collecting portions and said refrigerant distributing portions are divided to the right and the left region, respectively;

said pair of tank portions communicate said refrigerant collecting portions with said refrigerant distributing portions, said pair of tank portions being in a right-and-left direction;

said refrigerant collecting portions, said refrigerant distributing portions and said pair of tank portions are formed by laminating a first header plate for connecting said tubes and having said tank portion, a first space-forming plate that exhibits a refrigerant collecting/distributing space function, an intersecting plate having communication-blocking portions for communicating said refrigerant collecting portions with said refrigerant distributing portions, said communication-blocking portions being in the right-and-left direction, in an intersecting manner, a second space-forming plate and a second tank header plate that has said tank portion; and the ends of fins arranged among said tubes are brought into contact with the outer surface of said tank portion formed in said header plate.

17. A refrigerant evaporator for exchanging heat between a fluid to be cooled flowing through an outer portion and a refrigerant flowing through an inner portion, the refrigerant evaporator comprising:

a first path portion and a second path portion extending between a refrigerant inlet portion and a refrigerant outlet portion;

a core portion formed by the tubes arranged in parallel;

refrigerant collecting portions where the refrigerant is collected after flowing through said first path portion;

refrigerant distributing portions for distributing the refrigerant to said second path portion; and a pair of tank portions for communicating said refrigerant collecting portions with said refrigerant distributing portions; wherein said core portion includes a first row of the tubes and a second row of the tubes to form said first path portion and said second path portion on a right and a left region;

said refrigerant collecting portions and said refrigerant distributing portions are divided to the right and the left region, respectively;

said pair of tank portions communicate said refrigerant collecting portions with said refrigerant distributing portions, said pair of tank portions being in a right-and-left direction;

said refrigerant collecting portions, said refrigerant distributing portions and said pair of tank portions are formed by laminating a first header plate for connecting said tubes and having said tank portion, a first space-forming plate that exhibits a refrigerant collecting/distributing space function, an intersecting plate having communication-blocking portions for communicating said refrigerant collecting portions with said refrigerant distributing portions, said communication-blocking portions being in the right-and-left direction, in an intersecting manner, a second space-forming plate and a second tank header plate that has said tank portion; and erected portions are formed in said space-forming plate at both ends in the longitudinal direction thereof so as to serve as means for sealing both ends in the longitudinal direction of said tank portions.

18. A refrigerant evaporator for exchanging heat between a fluid to be cooled flowing through an outer portion and a refrigerant flowing through an inner portion, the refrigerant evaporator comprising:

a first path portion and a second path portion extending between a refrigerant inlet portion and a refrigerant outlet portion;

a core portion formed by the tubes arranged in parallel;

refrigerant collecting portions where the refrigerant is collected after flowing through said first path portion;

refrigerant distributing portions for distributing the refrigerant to said second path portion; and a pair of tank portions for communicating said refrigerant collecting portions with said refrigerant distributing portions; wherein said core portion includes a first row of the tubes and a second row of the tubes to form said first path portion and said second path portion on a right and a left region;

said refrigerant collecting portions and said refrigerant distributing portions are divided to the right and the left region, respectively;

said pair of tank portions communicate said refrigerant collecting portions with said refrigerant distributing portions, said pair of tank portions being in a right-and-left direction;

said refrigerant collecting portions, said refrigerant distributing portions and said pair of tank portions are formed by laminating a first header plate for connecting said tubes and having said tank portion, a first space-forming plate that exhibits a refrigerant collecting/distributing space function, an intersecting plate having communication-blocking portions for communicating said refrigerant collecting portions with said refrigerant distributing portions, said communication-blocking portions being in the right-and-left direction, in an intersecting manner, a second space-forming plate and a second tank header plate that has said tank portion; and narrow holes are formed in said space-forming plate and in said intersecting plate at both ends in the longitudinal direction, and longitudinally elongated caps are inserted in the narrow holes so as to serve as means for sealing both ends in the longitudinal direction of said tank portions.

19. A refrigerant evaporator for exchanging heat between a fluid to be cooled flowing through an outer portion and a refrigerant flowing through an inner portion, the refrigerant evaporator comprising a first path portion and a second path portion extending between a refrigerant inlet portion and a refrigerant outlet portion;

a core portion formed by tubes arranged in parallel;

refrigerant collecting portions where the refrigerant is collected after flowing through said first path portion; and refrigerant distributing portions for distributing the refrigerant to said second path portion; wherein said core portion includes a first row of the tubes on a front side and a second row of the tubes on a rear side to form said first path portion and said second path portion on substantially a right and a left region;

said refrigerant collecting portions include a structure for collecting the refrigerant from said first path portion in a manner of being divided to the right region and the left region;

said refrigerant distributing portions are formed by a pair of tank portions disposed on the front side and the rear side, respectively, the refrigerant distributing portions have a structure in which said second path portion is formed in a region different from said first path portion in terms of a right-and-left direction;

said refrigerant collecting portions and said refrigerant distributing portions are connected together through a pair of communication members; and a front-and-back right-and-left cross path for passing the refrigerant into different regions crossing back and forth and right and left, is formed by using the said tubes over the whole or part of the core surface in the refrigerant evaporator having a plurality of rows of said tubes in a direction in which the fluid to be cooled flows.

20. A refrigerant evaporator for exchanging heat between a fluid to be cooled flowing through an outer portion and a refrigerant flowing through an inner portion, the refrigerant evaporator comprising a first path portion and a second path portion extending between a refrigerant inlet portion and a refrigerant outlet portion;

a core portion formed by tubes arranged in parallel;

refrigerant collecting portions where the refrigerant is collected after flowing through said first path portion; and refrigerant distributing portions for distributing the refrigerant to said second path portion; wherein said core portion includes a first row of the tubes on a front side and a second row of the tubes on a rear side to form said first path portion and said second path portion on substantially a right and a left region;

said refrigerant collecting portions include a structure for collecting the refrigerant from said first path portion in a manner of being divided to the right region and the left region;

said refrigerant distributing portions are formed by a pair of tank portions disposed on the front side and the rear side, respectively, the refrigerant distributing portions have a structure in which said second path portion is formed in a region different from said first path portion in terms of a right-and-left direction;

said refrigerant collecting portions and said refrigerant distributing portions are connected together through a pair of communication members; and said refrigerant collecting portions and said refrigerant distributing portions are formed by stacking a header plate for connecting said tubes, a tank header plate forming the tank portions integrally together, and a distributing plate disposed therebetween and forming communication holes for communicating said tubes with said tank portions; and when some of said header plates, said distributing plate, said tank header plates, said space-forming plate and said intersecting plate are stacked and are bonded together by caulking, the caulking portions are arranged among said tubes.

21. A refrigerant evaporator for exchanging heat between a fluid to be cooled flowing through an outer portion and a refrigerant flowing through an inner portion, the refrigerant evaporator comprising a first path portion and a second path portion extending between a refrigerant inlet portion and a refrigerant outlet portion;

a core portion formed by tubes arranged in parallel;

refrigerant collecting portions where the refrigerant is collected after flowing through said first path portion; and refrigerant distributing portions for distributing the refrigerant to said second path portion; wherein said core portion includes a first row of the tubes on a front side and a second row of the tubes on a rear side to form said first path portion and said second path portion on substantially a right and a left region;

said refrigerant collecting portions include a structure for collecting the refrigerant from said first path portion in a manner of being divided to the right region and the left region;

said refrigerant distributing portions are formed by a pair of tank portions disposed on the front side and the rear side, respectively, the refrigerant distributing portions have a structure in which said second path portion is formed in a region different from said first path portion in terms of a right-and-left direction;

said refrigerant collecting portions and said refrigerant distributing portions are connected together through a pair of communication members; and said refrigerant collecting portions and said refrigerant distributing portions are formed by stacking a header plate for connecting said tubes, a tank header plate forming the tank portions integrally together, and a distributing plate disposed therebetween and forming communication holes for communicating said tubes with said tank portions; and any one of said distributing plate, said space-forming plate or said intersecting plate is constituted by a double-sided clad member.

* * * * *